US011828243B2

(12) United States Patent
Aoki

(10) Patent No.: US 11,828,243 B2
(45) Date of Patent: Nov. 28, 2023

(54) EXHAUST GAS CONTROL APPARATUS AND EXHAUST GAS CONTROL METHOD FOR INTERNAL COMBUSTION ENGINE

(71) Applicant: TOYOTA JIDOSHA KABUSHIKI KAISHA, Toyota (JP)

(72) Inventor: Keiichiro Aoki, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 18/110,196

(22) Filed: Feb. 15, 2023

(65) Prior Publication Data

US 2023/0340918 A1 Oct. 26, 2023

(30) Foreign Application Priority Data

Apr. 25, 2022 (JP) ..... 2022-071659

(51) Int. Cl.

| | |
|---|---|
| ***F02D 41/14*** | (2006.01) |
| ***F01N 11/00*** | (2006.01) |
| ***F01N 3/08*** | (2006.01) |
| ***F02D 41/40*** | (2006.01) |

(52) U.S. Cl.

CPC ..... *F02D 41/1454* (2013.01); *F01N 3/0864* (2013.01); *F01N 11/005* (2013.01); *F01N 11/007* (2013.01); *F01N 2430/02* (2013.01); *F01N 2430/06* (2013.01); *F01N 2430/08* (2013.01); *F01N 2430/085* (2013.01); *F01N 2560/025* (2013.01); *F01N 2900/0408* (2013.01); *F01N 2900/0411* (2013.01); *F01N 2900/0416* (2013.01); *F01N 2900/1624* (2013.01); *F02D 41/401* (2013.01); (Continued)

(58) Field of Classification Search

CPC combination set(s) only.
See application file for complete search history.

(56) References Cited

U.S. PATENT DOCUMENTS

| | | | | |
|---|---|---|---|---|
| 2013/0111886 | A1* | 5/2013 | Gonze | F01N 3/2066 60/286 |
| 2017/0159592 | A1* | 6/2017 | Okazaki | F02D 41/1495 |
| 2017/0167418 | A1* | 6/2017 | Okubo | F01N 11/007 |

(Continued)

FOREIGN PATENT DOCUMENTS

| | | |
|---|---|---|
| JP | H 09-126012 A | 5/1997 |
| JP | 2008-128110 A | 6/2008 |

*Primary Examiner* — Binh Q Tran

(74) *Attorney, Agent, or Firm* — Finnegan, Henderson, Farabow, Garrett & Dunner, LLP

(57) ABSTRACT

An exhaust gas control apparatus for an internal combustion engine includes: a catalyst disposed in an exhaust passage of the engine and configured to be able to occlude oxygen; an air-fuel ratio sensor that detects an air-fuel ratio of an out-flow exhaust gas; and an air-fuel ratio control device that controls an air-fuel ratio of an in-flow exhaust gas to a target air-fuel ratio. The device executes air-fuel ratio reduction control in which the target air-fuel ratio is set to a rich setting air-fuel ratio, and corrects a parameter related to the air-fuel ratio reduction control such that an amount of a reducing gas supplied to the catalyst is decreased when a minimum air-fuel ratio obtained when the detected air-fuel ratio is varied to a rich side is richer than the rich setting air-fuel ratio or an average value of detected air-fuel ratios of the in-flow exhaust gas.

8 Claims, 18 Drawing Sheets

(52) U.S. Cl.
CPC .... *F02D 41/405* (2013.01); *F02D 2200/0814* (2013.01); *F02D 2200/0816* (2013.01)

(56) References Cited

U.S. PATENT DOCUMENTS

| | | | | |
|---|---|---|---|---|
| 2017/0350337 | A1* | 12/2017 | Date | F02P 5/145 |
| 2018/0283302 | A1* | 10/2018 | Hayashita | F02D 41/1447 |
| 2019/0136737 | A1* | 5/2019 | Umezawa | F02D 41/0295 |
| 2019/0136778 | A1* | 5/2019 | Inoshita | F02D 41/1441 |
| 2019/0316535 | A1* | 10/2019 | Imai | F02D 41/144 |

* cited by examiner

EXHAUST GAS CONTROL APPARATUS AND EXHAUST GAS CONTROL METHOD FOR INTERNAL COMBUSTION ENGINE

CROSS-REFERENCE TO RELATED APPLICATION

This application claims priority to Japanese Patent Application No. 2022-071659 filed on Apr. 25, 2022, incorporated herein by reference in its entirety.

BACKGROUND

1. Technical Field

The present disclosure relates to an exhaust gas control apparatus and an exhaust gas control method for an internal combustion engine.

2. Description of Related Art

It has hitherto been known to dispose a catalyst that can occlude oxygen in an exhaust passage of an internal combustion engine to control HC, CO, NOx, etc. in an exhaust gas in the catalyst. In internal combustion engines described in Japanese Unexamined Patent Application Publication No. 2008-128110 (JP 2008-128110 A) and Japanese Unexamined Patent Application Publication No. 09-126012 (JP 09-126012 A), the air-fuel ratio of an exhaust gas is controlled based on an output from an air-fuel ratio sensor disposed downstream of a catalyst, in order to enhance the exhaust gas control performance of the catalyst.

When oxygen is depleted in the catalyst, however, a water gas shift reaction and a steam reforming reaction are caused, and hydrogen generated through these reactions flows out of the catalyst. As a result, an error is caused in the output from the air-fuel ratio sensor disposed downstream of the catalyst. JP 2008-128110 A describes calculating an error in the output from the air-fuel ratio sensor due to the hydrogen generated in the catalyst and setting a target air-fuel ratio so as to cancel out the output error.

SUMMARY

However, the technique described in JP 2008-128110 A cannot reduce the amount of hydrogen generated in the catalyst, and therefore exhaust emission may be degraded when the precision in calculating the output error is reduced.

Thus, the present disclosure provides a technique of suppressing excessive generation of hydrogen in a catalyst when the air-fuel ratio of an exhaust gas is controlled based on an output from an air-fuel ratio sensor disposed downstream of the catalyst.

A first aspect of the present disclosure relates to an exhaust gas control apparatus for an internal combustion engine including a catalyst, an air-fuel ratio sensor, and an air-fuel ratio control device. The catalyst is disposed in an exhaust passage of the internal combustion engine, and configured to be able to occlude oxygen. The air-fuel ratio sensor is configured to detect an air-fuel ratio of an out-flow exhaust gas that flows out of the catalyst. The air-fuel ratio control device is configured to control an air-fuel ratio of an in-flow exhaust gas that flows into the catalyst to a target air-fuel ratio. The air-fuel ratio control device is configured to execute air-fuel ratio reduction control in which the target air-fuel ratio is set to a rich setting air-fuel ratio that is richer than a stoichiometric air-fuel ratio, and to correct a parameter related to the air-fuel ratio reduction control such that an amount of a reducing gas supplied to the catalyst in the air-fuel ratio reduction control is decreased in a case where a minimum air-fuel ratio obtained when the air-fuel ratio of the out-flow exhaust gas detected by the air-fuel ratio sensor is varied to a rich side through the air-fuel ratio reduction control is richer than the rich setting air-fuel ratio or an average value of detected air-fuel ratios of the in-flow exhaust gas in the air-fuel ratio reduction control.

In the exhaust gas control apparatus according to the first aspect described above, the air-fuel ratio control device may be configured to correct the parameter related to the air-fuel ratio reduction control to a lean side when the minimum air-fuel ratio is richer than the rich setting air-fuel ratio or the detected air-fuel ratio.

In the exhaust gas control apparatus configured as described above, the air-fuel ratio control device may be configured to end the air-fuel ratio reduction control when the air-fuel ratio of the out-flow exhaust gas detected by the air-fuel ratio sensor is reduced to be equal to or less than a lower determination air-fuel ratio that is richer than the stoichiometric air-fuel ratio in the air-fuel ratio reduction control. The parameter related to the air-fuel ratio reduction control may include the lower determination air-fuel ratio.

In the exhaust gas control apparatus configured as described above, the air-fuel ratio control device may be configured to start air-fuel ratio increase control in which the target air-fuel ratio is set to a lean setting air-fuel ratio that is leaner than the stoichiometric air-fuel ratio when the air-fuel ratio of the out-flow exhaust gas detected by the air-fuel ratio sensor is reduced to be equal to or less than a lower determination air-fuel ratio that is richer than the stoichiometric air-fuel ratio in the air-fuel ratio reduction control, and to start the air-fuel ratio reduction control when the air-fuel ratio of the out-flow exhaust gas detected by the air-fuel ratio sensor is increased to be equal to or more than an upper determination air-fuel ratio that is leaner than the lower determination air-fuel ratio in the air-fuel ratio increase control. The parameter related to the air-fuel ratio reduction control may include the lower determination air-fuel ratio and the upper determination air-fuel ratio.

In the exhaust gas control apparatus configured as described above, the parameter related to the air-fuel ratio reduction control may include the rich setting air-fuel ratio.

In the exhaust gas control apparatus according to the aspect described above, the parameter related to the air-fuel ratio reduction control may include a time of execution of the air-fuel ratio reduction control.

In the exhaust gas control apparatus according to the first aspect described above, the air-fuel ratio control device may be configured to start air-fuel ratio increase control in which the target air-fuel ratio is set to a lean setting air-fuel ratio that is leaner than the stoichiometric air-fuel ratio when the air-fuel ratio of the out-flow exhaust gas detected by the air-fuel ratio sensor is reduced to be equal to or less than a lower determination air-fuel ratio that is richer than the stoichiometric air-fuel ratio in the air-fuel ratio reduction control, and to start the air-fuel ratio reduction control when the air-fuel ratio of the out-flow exhaust gas detected by the air-fuel ratio sensor is increased to be equal to or more than an upper determination air-fuel ratio that is leaner than the lower determination air-fuel ratio in the air-fuel ratio increase control. The air-fuel ratio control device may be configured to correct the upper determination air-fuel ratio and the lower determination air-fuel ratio such that a difference between the upper determination air-fuel ratio and the lower determination air-fuel ratio becomes small when the air-fuel ratio of the out-flow exhaust gas detected by the air-fuel ratio sensor is not varied to a lean side during a period since the air-fuel ratio increase control is started until a predetermined threshold time elapses.

A second aspect of the present disclosure relates to an exhaust gas control method for an internal combustion engine including a catalyst, an air-fuel ratio sensor, and an air-fuel ratio control device. The catalyst is disposed in an exhaust passage of the internal combustion engine, and configured to be able to occlude oxygen. The air-fuel ratio sensor is configured to detect an air-fuel ratio of an out-flow exhaust gas that flows out of the catalyst. The air-fuel ratio control device is configured to control an air-fuel ratio of an in-flow exhaust gas that flows into the catalyst to a target air-fuel ratio. The exhaust gas control method for an internal combustion engine includes: (i) executing air-fuel ratio reduction control in which the target air-fuel ratio is set to a rich setting air-fuel ratio that is richer than a stoichiometric air-fuel ratio; and (ii) correcting a parameter related to the air-fuel ratio reduction control such that an amount of a reducing gas supplied to the catalyst in the air-fuel ratio reduction control is decreased in a case where a minimum air-fuel ratio obtained when the air-fuel ratio of the out-flow exhaust gas detected by the air-fuel ratio sensor is varied to a rich side through the air-fuel ratio reduction control is richer than the rich setting air-fuel ratio or an average value of detected air-fuel ratios of the in-flow exhaust gas in the air-fuel ratio reduction control.

With the exhaust gas control apparatus and the exhaust gas control method for an internal combustion engine according to the present disclosure, it is possible to suppress excessive generation of hydrogen in a catalyst when the air-fuel ratio of an exhaust gas is controlled based on an output from an air-fuel ratio sensor disposed downstream of the catalyst.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Embodiments of the present disclosure will be described below in detail with reference to the drawings. In the following description, like constituent elements are denoted by like reference signs.

First, a first embodiment of the present disclosure will be described with reference to FIGS. 1 to 7D.

Figure 1:
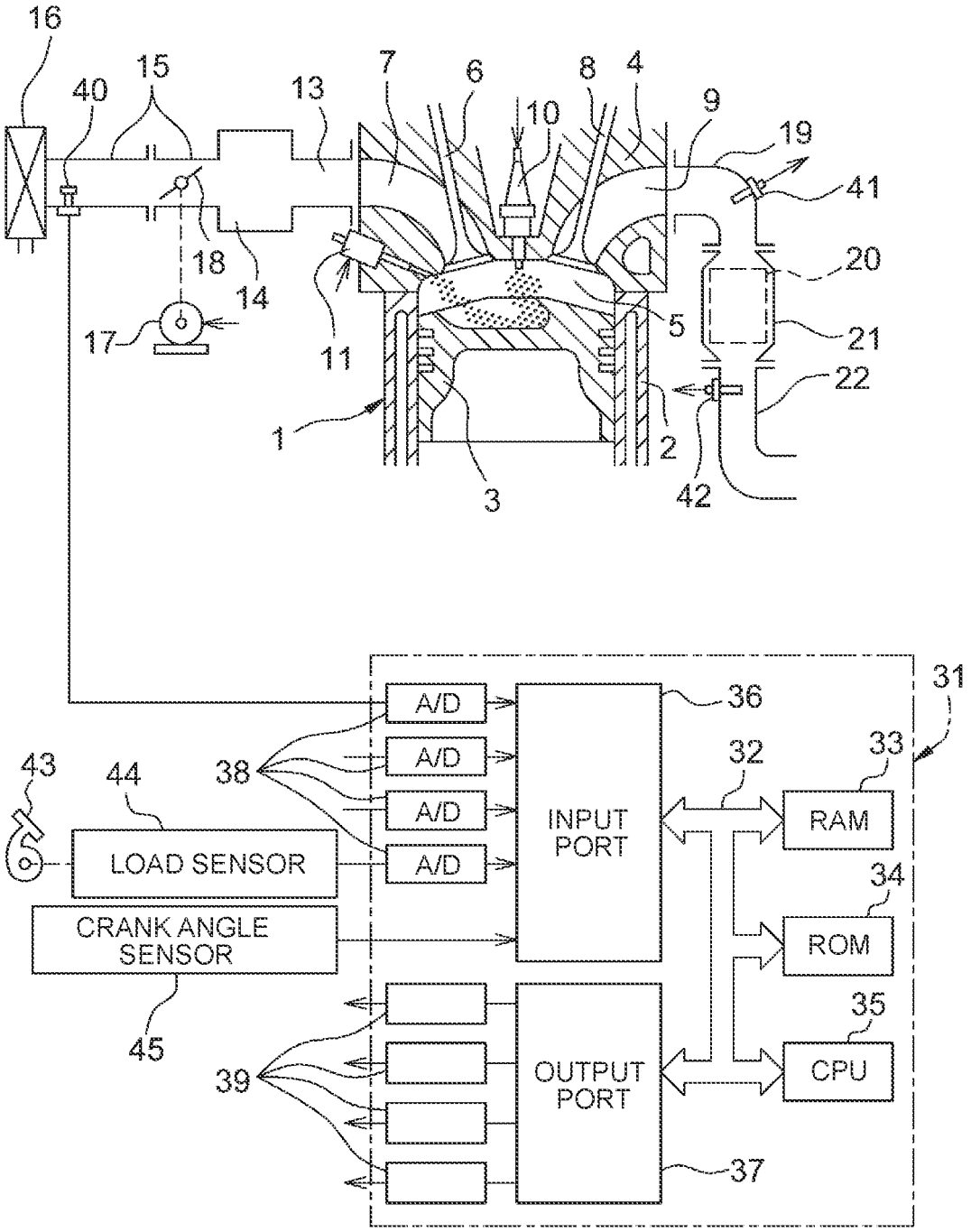
FIG. 1 schematically illustrates an internal combustion engine with an exhaust gas control apparatus for an internal combustion engine according to a first embodiment of the present disclosure.

First, the entire internal combustion engine is described. FIG. 1 schematically illustrates an internal combustion engine with an exhaust gas control apparatus for an internal combustion engine according to the first embodiment of the present disclosure. The internal combustion engine illustrated in FIG. 1 is a spark-ignition internal combustion engine. The internal combustion engine is mounted on a vehicle, and used as a power source for the vehicle.

The internal combustion engine includes an engine body 1 that includes a cylinder block 2 and a cylinder head 4. A plurality of (e.g. four) cylinders is formed inside the cylinder block 2. A piston 3 is disposed in each cylinder to reciprocate in the direction of the axis of the cylinder. A combustion chamber 5 is formed between the piston 3 and the cylinder head 4.

An intake port 7 and an exhaust port 9 are formed in the cylinder head 4. The intake port 7 and the exhaust port 9 are connected to the combustion chamber 5.

The internal combustion engine also includes an intake valve 6 and an exhaust valve 8 disposed in the cylinder head 4. The intake valve 6 opens and closes the intake port 7. The exhaust valve 8 opens and closes the exhaust port 9.

The internal combustion engine includes a spark plug 10 and a fuel injection valve 11. The spark plug 10 is disposed at the central portion of the inner wall surface of the cylinder head 4, and generates a spark in accordance with an ignition signal. The fuel injection valve 11 is disposed at the peripheral portion of the inner wall surface of the cylinder head 4, and injects fuel into the combustion chamber 5 in accordance with an injection signal. In the first embodiment, gasoline with a stoichiometric air-fuel ratio of 14.6 is used as fuel to be supplied to the fuel injection valve 11.

The internal combustion engine also includes an intake manifold 13, a surge tank 14, an intake pipe 15, an air cleaner 16, and a throttle valve 18. The intake port 7 of each cylinder is coupled to the surge tank 14 via the corresponding intake manifold 13. The surge tank 14 is coupled to the air cleaner 16 via the intake pipe 15. The intake port 7, the intake manifold 13, the surge tank 14, the intake pipe 15, etc. form an intake passage that leads air to the combustion chamber 5. The throttle valve 18 is disposed in the intake pipe 15 between the surge tank 14 and the air cleaner 16, and driven by a throttle valve drive actuator 17 (e.g. a direct current (DC) motor). The throttle valve 18 is turned by the throttle valve drive actuator 17 to be able to change the area of opening of the intake passage in accordance with the degree of opening of the throttle valve 18.

The internal combustion engine also includes an exhaust manifold 19, a catalyst 20, a casing 21, and an exhaust pipe 22. The exhaust port 9 of each cylinder is coupled to the exhaust manifold 19. The exhaust manifold 19 has a plurality of branched portions coupled to the respective exhaust ports 9 and a merged portion at which the branched portions are merged. The merged portion of the exhaust manifold 19 is coupled to the casing 21 in which the catalyst 20 is provided. The casing 21 is coupled to the exhaust pipe 22. The exhaust port 9, the exhaust manifold 19, the casing 21, the exhaust pipe 22, etc. form an exhaust passage that discharges an exhaust gas generated through combustion of an air-fuel mixture in the combustion chamber 5.

The vehicle on which the internal combustion engine is mounted is provided with an electronic control unit (ECU) 31. As illustrated in FIG. 1, the ECU 31 is composed of a digital computer, and includes a random-access memory (RAM) 33, a read only memory (ROM) 34, a central processing unit (CPU; microprocessor) 35, an input port 36, and an output port 37, which are connected to each other via a bidirectional bus 32. While one ECU 31 is provided in the first embodiment, a plurality of ECUs may be provided for each function.

The ECU 31 executes various types of control of the internal combustion engine based on outputs etc. from various sensors provided in the vehicle or the internal combustion engine. Therefore, the outputs from the various sensors are transmitted to the ECU 31. In the first embodiment, outputs from an air flow meter 40, an upstream air-fuel ratio sensor 41, a downstream air-fuel ratio sensor 42, a load sensor 44, and a crank angle sensor 45 are transmitted to the ECU 31. The downstream air-fuel ratio sensor 42 is an example of the "air-fuel ratio sensor" according to the present disclosure.

The air flow meter 40 is disposed in the intake passage of the internal combustion engine, specifically in the intake pipe 15 upstream of the throttle valve 18. The air flow meter 40 detects the flow rate of air that flows through the intake passage. The air flow meter 40 is electrically connected to the ECU 31. An output from the air flow meter 40 is input to the input port 36 via a corresponding analog-digital (AD) converter 38.

The upstream air-fuel ratio sensor 41 is disposed in the exhaust passage upstream of the catalyst 20, specifically at the merged portion of the exhaust manifold 19. The upstream air-fuel ratio sensor 41 detects the air-fuel ratio of an exhaust gas that flows in the exhaust manifold 19, that is, an exhaust gas discharged from the cylinders of the internal combustion engine and flowing into the catalyst 20. The upstream air-fuel ratio sensor 41 is electrically connected to the ECU 31. An output from the upstream air-fuel ratio sensor 41 is input to the input port 36 via a corresponding AD converter 38.

The downstream air-fuel ratio sensor 42 is disposed in the exhaust passage downstream of the catalyst 20, specifically in the exhaust pipe 22. The downstream air-fuel ratio sensor 42 detects the air-fuel ratio of an exhaust gas that flows in the exhaust pipe 22, that is, an exhaust gas that flows out of the catalyst 20. The downstream air-fuel ratio sensor 42 is electrically connected to the ECU 31. An output from the downstream air-fuel ratio sensor 42 is input to the input port 36 via a corresponding AD converter 38.

The load sensor 44 is connected to an accelerator pedal 43 provided in the vehicle on which the internal combustion engine is mounted, and detects the amount of depression of the accelerator pedal 43. The load sensor 44 is electrically connected to the ECU 31. An output from the load sensor 44 is input to the input port 36 via a corresponding AD converter 38. The ECU 31 calculates an engine load based on the output from the load sensor 44.

The crank angle sensor 45 generates an output pulse each time a crankshaft of the internal combustion engine is rotated by a predetermined angle (e.g. 10 degrees). The crank angle sensor 45 is electrically connected to the ECU 31. An output from the crank angle sensor 45 is input to the input port 36. The ECU 31 calculates an engine rotational speed based on the output from the crank angle sensor 45.

On the other hand, the output port 37 of the ECU 31 is connected to the spark plug 10, the fuel injection valve 11, and the throttle valve drive actuator 17 via corresponding drive circuits 39, allowing the ECU 31 to control the spark plug 10, the fuel injection valve 11, and the throttle valve drive actuator 17. Specifically, the ECU 31 controls the ignition timing of the spark plug 10, the injection timing and the injection amount of fuel injected from the fuel injection valve 11, and the degree of opening of the throttle valve 18.

While the internal combustion engine discussed above is a non-supercharged internal combustion engine that uses gasoline as fuel, the configuration of the internal combustion engine is not limited to the above configuration. Thus, the specific configuration of the internal combustion engine, such as the cylinder arrangement, the manner of fuel injection, the configuration of the intake and exhaust systems, the configuration of the valve moving mechanism, the presence or absence of a supercharger, may be different from the configuration illustrated in FIG. 1. For example, the fuel injection valve 11 may be disposed so as to inject fuel into the intake port 7. The internal combustion engine may be provided with a component that allows an exhaust gas recirculation (EGR) gas to be recirculated from the exhaust passage to the intake passage.

An exhaust gas control apparatus for an internal combustion engine (hereinafter simply referred to as an "exhaust gas control apparatus") according to the first embodiment of the present disclosure will be described below. The exhaust gas control apparatus includes the catalyst 20, the upstream air-fuel ratio sensor 41, the downstream air-fuel ratio sensor 42, and an air-fuel ratio control device. In the present embodiment, the ECU 31 functions as an air-fuel ratio control device.

The catalyst 20 is disposed in the exhaust passage of the internal combustion engine, and configured to control an exhaust gas that flows through the exhaust passage. In the present embodiment, the catalyst 20 is a three-way catalyst that can occlude oxygen and that can control hydrocarbon (HC), carbon monoxide (CO), and nitrogen oxide (NOx) at the same time, for example. The catalyst 20 includes a carrier (base material) composed of ceramic or metal, precious metal having a catalytic action (e.g. platinum (Pt), palladium (Pd), and rhodium (Rh), etc.), and a promoter having an oxygen occlusion capability (e.g. ceria ($CeO_2$), etc.). The precious metal and the promotor are carried by the carrier.

Figure 2:
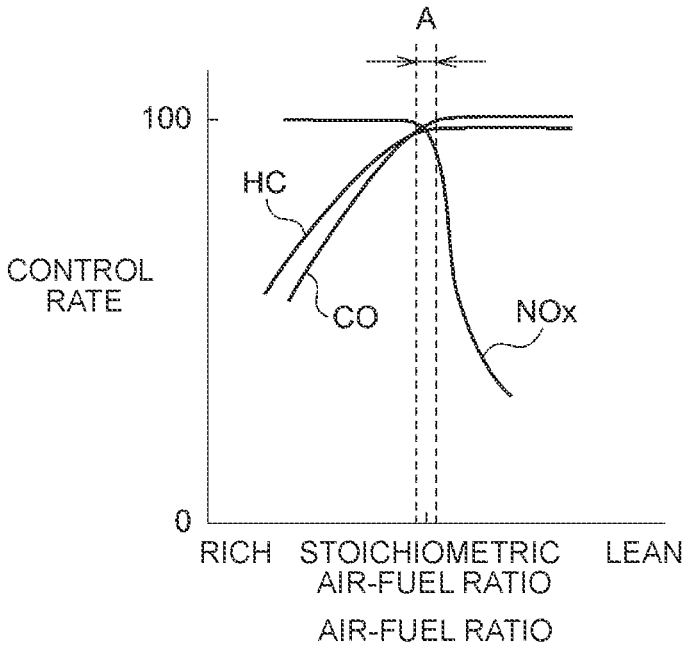
FIG. 2 illustrates an example of the control properties of a catalyst (three-way catalyst) illustrated in FIG. 1.

FIG. 2 illustrates an example of the control properties of the three-way catalyst. As indicated in FIG. 2, the rate of control of HC, CO, and NOx by the three-way catalyst is significantly high when the air-fuel ratio of an exhaust gas that flows into the three-way catalyst is in a region in the vicinity of the stoichiometric air-fuel ratio (control window A in FIG. 2). Thus, the catalyst 20 can effectively control HC, CO, and NOx when the air-fuel ratio of the exhaust gas is maintained in the vicinity of the stoichiometric air-fuel ratio.

The catalyst 20 occludes and releases oxygen in accordance with the air-fuel ratio of the exhaust gas using the promoter. Specifically, the catalyst 20 occludes excessive oxygen in the exhaust gas when the air-fuel ratio of the exhaust gas is leaner than the stoichiometric air-fuel ratio. On the other hand, the catalyst 20 releases oxygen that is short for oxidizing HC and CO when the air-fuel ratio of the exhaust gas is richer than the stoichiometric air-fuel ratio. As a result, the air-fuel ratio on the surface of the catalyst 20 is maintained in the vicinity of the stoichiometric air-fuel ratio even when the air-fuel ratio of the exhaust gas slightly deviates from the stoichiometric air-fuel ratio, and HC, CO, and NOx are effectively controlled in the catalyst 20.

The upstream air-fuel ratio sensor 41 and the downstream air-fuel ratio sensor 42 are disposed in the exhaust passage of the internal combustion engine. The downstream air-fuel ratio sensor 42 is disposed downstream of the upstream air-fuel ratio sensor 41. The upstream air-fuel ratio sensor 41 and the downstream air-fuel ratio sensor 42 are each configured to detect the air-fuel ratio of the exhaust gas that flows through the exhaust passage.

Figure 3:
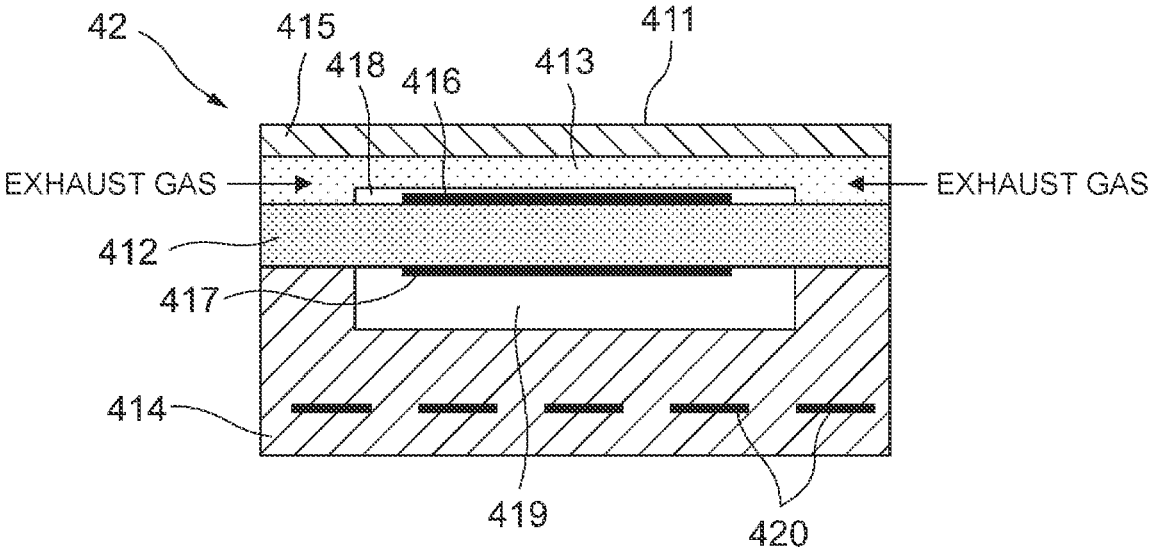
FIG. 3 is a partial sectional view of a downstream air-fuel ratio sensor illustrated in FIG. 1.

FIG. 3 is a partial sectional view of the downstream air-fuel ratio sensor 42. The configuration of the downstream air-fuel ratio sensor 42, which has a known configuration, will be briefly described below. The upstream air-fuel ratio sensor 41 has the same configuration as that of the downstream air-fuel ratio sensor 42.

The downstream air-fuel ratio sensor 42 includes a sensor element 411 and heaters 420. In the present embodiment, the downstream air-fuel ratio sensor 42 is a stacked air-fuel ratio sensor constituted by stacking a plurality of layers. As illustrated in FIG. 3, the sensor element 411 has a solid electrolyte layer 412, a diffusion limitation layer 413, a first impermeable layer 414, a second impermeable layer 415, an exhaust-side electrode 416, and an atmosphere-side electrode 417. A measured gas chamber 418 is formed between the solid electrolyte layer 412 and the diffusion limitation layer 413. An atmosphere chamber 419 is formed between the solid electrolyte layer 412 and the first impermeable layer 414.

The exhaust gas is introduced into the measured gas chamber 418 via the diffusion limitation layer 413 as a gas to be measured. The atmosphere is introduced into the atmosphere chamber 419. When a voltage is applied to the sensor element 411, oxide ions are moved between the exhaust-side electrode 416 and the atmosphere-side electrode 417 in accordance with the air-fuel ratio of the exhaust gas on the exhaust-side electrode 416, as a result of which the output current from the sensor element 411 is varied in accordance with the air-fuel ratio of the exhaust gas.

Figure 4:
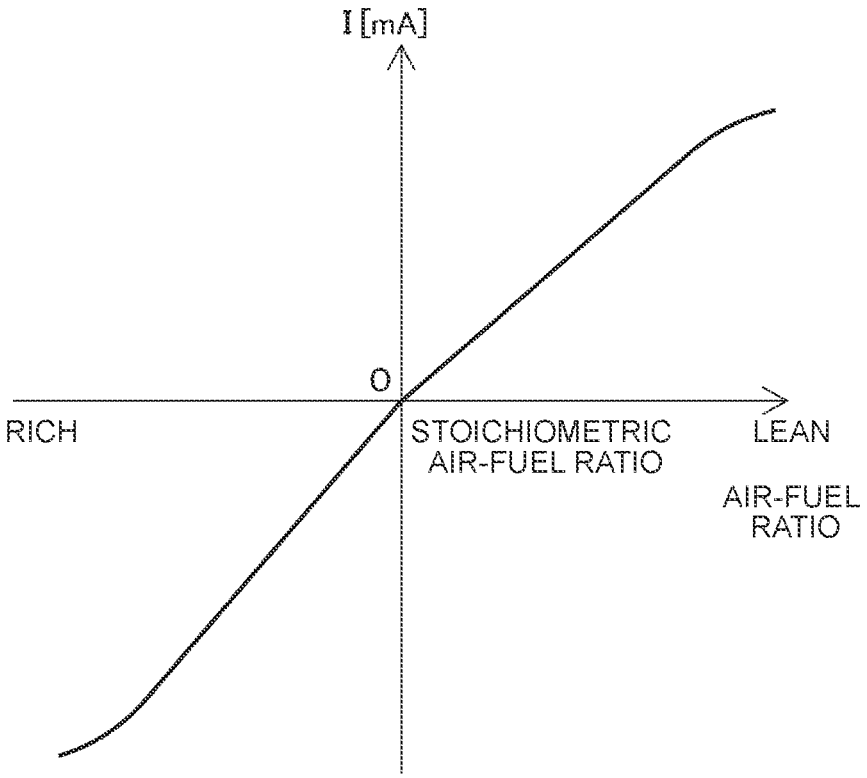
FIG. 4 illustrates the relationship between the air-fuel ratio of an exhaust gas and an output current from a sensor element in the downstream air-fuel ratio sensor.

FIG. 4 illustrates the relationship between the air-fuel ratio of the exhaust gas and the output current I from the sensor element 411 in the downstream air-fuel ratio sensor 42. In the example in FIG. 4, a voltage of 0.45 V is applied to the sensor element 411. As can be seen from FIG. 4, an output current I is zero when the air-fuel ratio of the exhaust gas is the stoichiometric air-fuel ratio. In the downstream air-fuel ratio sensor 42, the output current I becomes larger as the concentration of oxygen in the exhaust gas becomes higher, that is, as the air-fuel ratio of the exhaust gas becomes leaner. Thus, the downstream air-fuel ratio sensor 42 and the upstream air-fuel ratio sensor 41, which has the same configuration as that of the downstream air-fuel ratio sensor 42, can continuously (linearly) detect the air-fuel ratio of the exhaust gas.

In the present embodiment, air-fuel ratio sensors of a limiting current type are used as the upstream air-fuel ratio sensor 41 and the downstream air-fuel ratio sensor 42. However, air-fuel ratio sensors that are not of a limiting current type may be used as the upstream air-fuel ratio sensor 41 and the downstream air-fuel ratio sensor 42 as long as an output current of such air-fuel ratio sensors is varied linearly with respect to the air-fuel ratio of the exhaust gas. The upstream air-fuel ratio sensor 41 and the downstream air-fuel ratio sensor 42 may be air-fuel ratio sensors of different structures.

The air-fuel ratio control device controls the air-fuel ratio of an exhaust gas that flows into the catalyst 20 (hereinafter referred to as an "in-flow exhaust gas") to a target air-fuel ratio. Specifically, the air-fuel ratio control device sets a target air-fuel ratio, and controls the amount of fuel supplied to the combustion chamber 5 such that the air-fuel ratio of the in-flow exhaust gas coincides with the target air-fuel ratio. For example, the air-fuel ratio control device sets a target air-fuel ratio for the in-flow exhaust gas based on the output from the downstream air-fuel ratio sensor 42, and performs feedback control of the amount of fuel supplied to the combustion chamber 5 such that the output air-fuel ratio of the upstream air-fuel ratio sensor 41 coincides with the target air-fuel ratio. The "output air-fuel ratio" means an air-fuel ratio corresponding to an output value from an air-fuel ratio sensor, that is, an air-fuel ratio detected by an air-fuel ratio sensor.

The air-fuel ratio control device may control the amount of fuel supplied to the combustion chamber 5 such that the air-fuel ratio of the in-flow exhaust gas coincides with the target air-fuel ratio without using the upstream air-fuel ratio sensor 41. In this case, the upstream air-fuel ratio sensor 41 is omitted from the exhaust gas control apparatus, and the air-fuel ratio control device calculates the amount of fuel supplied to the combustion chamber 5 from the intake air amount, the engine rotational speed, and the target air-fuel ratio such that the ratio of fuel and air supplied to the combustion chamber 5 coincides with the target air-fuel ratio.

In the present embodiment, the air-fuel ratio of the in-flow exhaust gas is basically controlled such that the catalyst 20 is maintained in the state of being suitable for exhaust gas control. When the catalyst 20 is in the state of being suitable for exhaust gas control, the exhaust gas is controlled in the catalyst 20, and the air-fuel ratio of an exhaust gas that flows out of the catalyst 20 (hereinafter referred to as an "out-flow exhaust gas") is brought to the stoichiometric air-fuel ratio. Therefore, it is conceivable to control the air-fuel ratio of the in-flow exhaust gas such that the output air-fuel ratio of the downstream air-fuel ratio sensor 42 disposed downstream of the catalyst 20 is brought to the stoichiometric air-fuel ratio.

When oxygen is depleted in the catalyst 20, however, a water gas shift reaction indicated by the following formula (1) and a steam reforming reaction indicated by the following formula (2) are caused to generate hydrogen in the catalyst 20.

$$CO+H_2O \rightarrow H_2+CO_2 \quad (1)$$

$$HC+H_2O \rightarrow CO+H_2 \quad (2)$$

As a result, an exhaust gas containing hydrogen flows out of the catalyst 20, and flows into the downstream air-fuel ratio sensor 42. At this time, the molecular weight of hydrogen is less than the molecular weight of oxygen, and therefore hydrogen in the exhaust gas passes through the diffusion limitation layer 413 and reaches the exhaust-side electrode 416 faster than oxygen in the exhaust gas. Therefore, the concentration of oxygen in the exhaust gas on the exhaust-side electrode 416 becomes lower than the concentration of oxygen in the exhaust gas in the exhaust passage. As a result, a deviation is caused in the output from the downstream air-fuel ratio sensor 42, and the output from the downstream air-fuel ratio sensor 42 deviates to the rich side from the actual value. Thus, the reliability of the output from the downstream air-fuel ratio sensor 42 is reduced when hydrogen flows into the downstream air-fuel ratio sensor 42 from the catalyst 20.

Figure 5A:
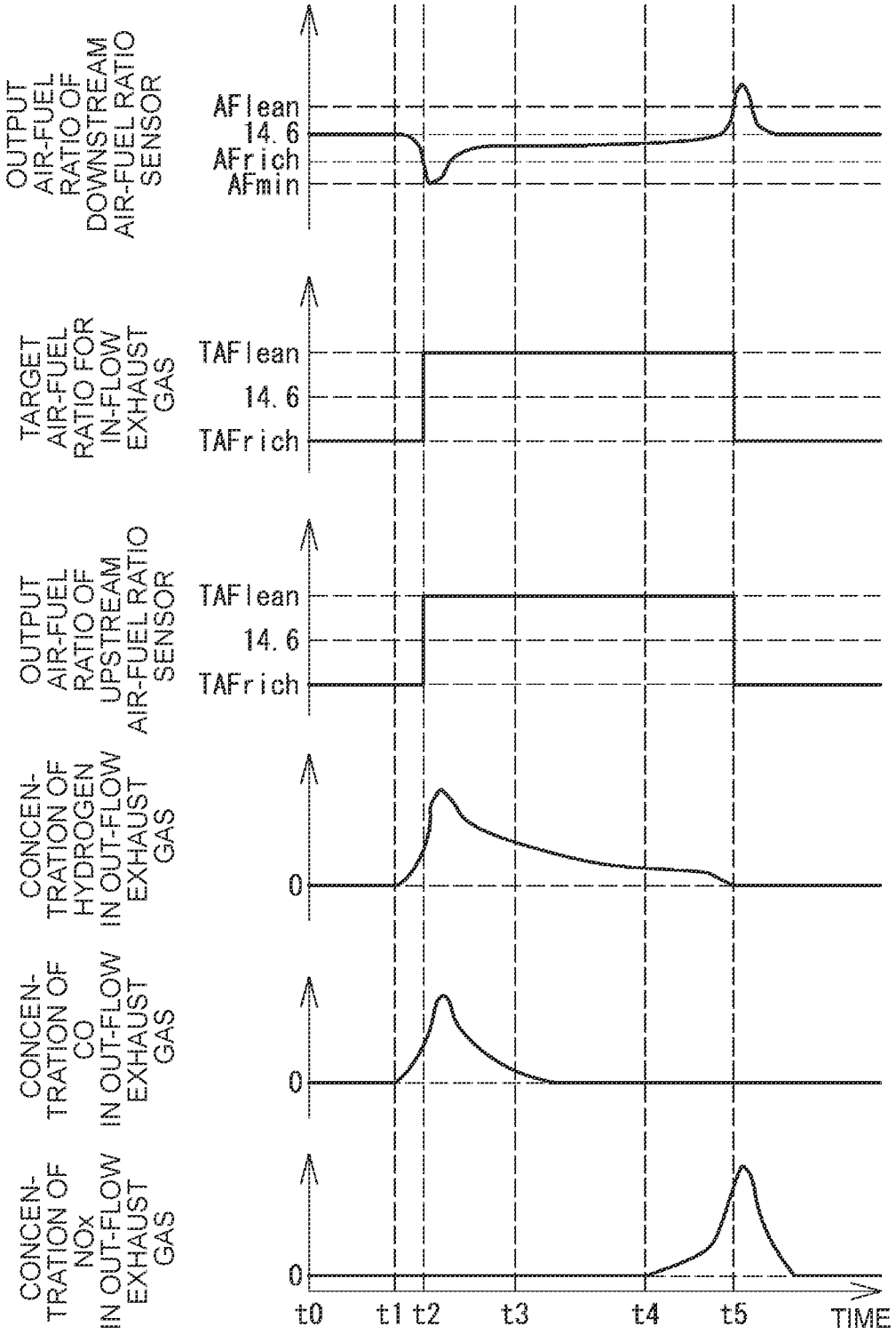
FIG. 5A is a time chart of various parameters at the time when the air-fuel ratio of an in-flow exhaust gas that flows into the catalyst is switched between an air-fuel ratio that is richer than the stoichiometric air-fuel ratio and an air-fuel ratio that is leaner than the stoichiometric air-fuel ratio.

FIG. 5A is a time chart of various parameters at the time when the air-fuel ratio of the in-flow exhaust gas is switched between an air-fuel ratio that is richer than the stoichiometric air-fuel ratio and an air-fuel ratio that is leaner than the stoichiometric air-fuel ratio. FIG. 5A indicates, as the parameters, the output air-fuel ratio of the downstream air-fuel ratio sensor 42, the target air-fuel ratio for the in-flow exhaust gas, the output air-fuel ratio of the upstream air-fuel ratio sensor 41, the concentration of hydrogen in the out-flow exhaust gas, the concentration of CO in the out-flow exhaust gas, and the concentration of NOx in the out-flow exhaust gas.

Figure 5B:
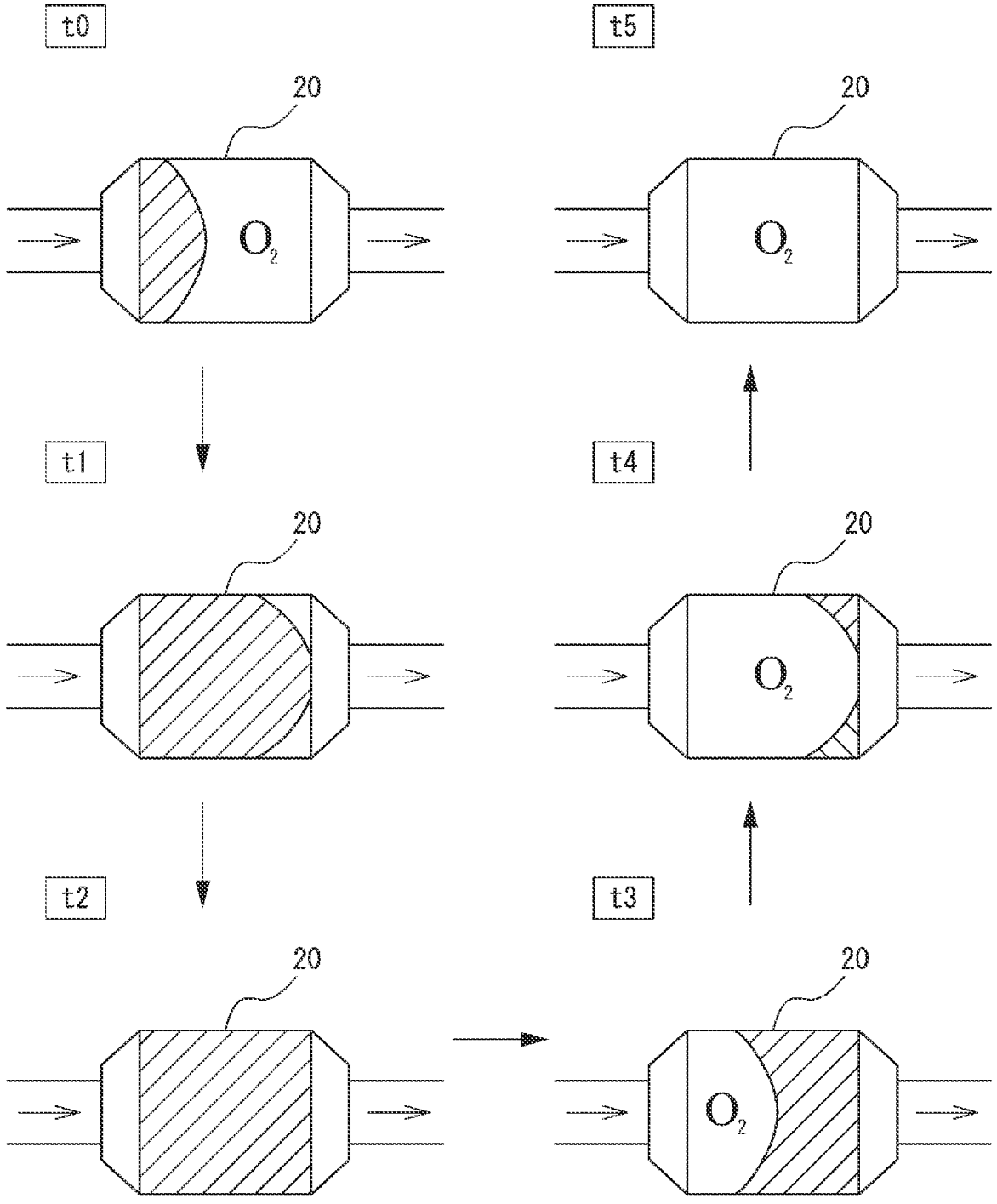
FIG. 5B schematically illustrates the state of oxygen occluded in the catalyst at each time in FIG. 5A.

FIG. 5B schematically illustrates the state of oxygen occluded in the catalyst 20 at each time (times t0 to t5) in FIG. 5A. FIG. 5B illustrates the state of oxygen occluded in the catalyst 20 together with the direction in which the exhaust gas flows through the catalyst 20. A hatched portion of the catalyst 20 indicates an oxygen depletion region in which oxygen has been depleted. The other portion of the catalyst 20 indicates a region filled with oxygen.

In this example, at time t0, the target air-fuel ratio for the in-flow exhaust gas is set to a rich setting air-fuel ratio TAFrich that is richer than the stoichiometric air-fuel ratio. When an exhaust gas at a rich air-fuel ratio flows into the catalyst 20 filled with oxygen, the oxygen is gradually released from the upstream side of the catalyst 20. As a result, at time t0, as illustrated in FIG. 5B, an oxygen depletion region is formed on the upstream side of the catalyst 20. In this case, hydrogen generated in the oxygen depletion region is oxidized on the downstream side of the catalyst 20, and therefore almost no hydrogen flows out of the catalyst 20. CO and NOx in the exhaust gas are effectively controlled in the catalyst 20, and therefore the output air-fuel ratio of the downstream air-fuel ratio sensor 42 is maintained at the stoichiometric air-fuel ratio.

After that, at time t1, most of the region of the catalyst 20 is brought into the oxygen depletion region, hydrogen and CO flow out of the catalyst 20, and the output air-fuel ratio of the downstream air-fuel ratio sensor 42 starts being varied to the rich side. In the example in FIG. 5A, when the output air-fuel ratio of the downstream air-fuel ratio sensor 42 reaches a rich determination air-fuel ratio AFrich at time t2, the target air-fuel ratio for the in-flow exhaust gas is switched from the rich setting air-fuel ratio TAFrich to a lean setting air-fuel ratio TAFlean that is leaner than the stoichiometric air-fuel ratio. At time t2, as illustrated in FIG. 5B, all the region of the catalyst 20 has been brought into the oxygen depletion region. The output air-fuel ratio of the downstream air-fuel ratio sensor 42 is reduced to a minimum air-fuel ratio AFmin also after time t2, and varied to the lean side from the minimum air-fuel ratio AFmin.

When an exhaust gas with a lean air-fuel ratio flows into the catalyst 20 in which oxygen has been depleted, the catalyst 20 is gradually filled with oxygen from the upstream side of the catalyst 20. As a result, at time t3, as illustrated in FIG. 5B, the upstream side of the catalyst 20 is filled with oxygen and the oxygen depletion region remains on the downstream side of the catalyst 20. In this case, CO and NOx in the exhaust gas are effectively controlled in the catalyst 20. However, hydrogen generated in the oxygen depletion region on the downstream side of the catalyst 20 flows into the downstream air-fuel ratio sensor 42 from the catalyst 20, and therefore the output air-fuel ratio of the downstream air-fuel ratio sensor 42 indicates a value that is richer than the stoichiometric air-fuel ratio.

After that, at time t4, most of the region of the catalyst 20 is filled with oxygen, and NOx starts flowing out of the catalyst 20. Also at this time, hydrogen generated in the oxygen depletion region that slightly remains on the downstream side of the catalyst 20 flows out of the catalyst 20, and the output from the downstream air-fuel ratio sensor 42 is affected by the hydrogen. In the example in FIG. 5A, when the output air-fuel ratio of the downstream air-fuel ratio sensor 42 reaches the lean determination air-fuel ratio AFlean at time 5, the target air-fuel ratio for the in-flow exhaust gas is switched from the lean setting air-fuel ratio TAFlean to the rich setting air-fuel ratio TAFrich. At time t5, as illustrated in FIG. 5B, all the region of the catalyst 20 is filled with oxygen. Therefore, an outflow of hydrogen from the catalyst 20 is ended at time t5.

As can be seen from FIG. 5A, when hydrogen is flowing out of the catalyst 20, the catalyst 20 is in the state of being suitable for exhaust gas control when the output air-fuel ratio of the downstream air-fuel ratio sensor 42 is richer than the stoichiometric air-fuel ratio. Therefore, when the air-fuel ratio of the in-flow exhaust gas is controlled such that the output air-fuel ratio of the downstream air-fuel ratio sensor 42 is brought to the stoichiometric air-fuel ratio irrespective of the situation of generation of hydrogen in the catalyst 20, the amount of NOx that flows out of the catalyst 20 is increased, which may degrade exhaust emission.

When no hydrogen is flowing out of the catalyst 20, on the other hand, the catalyst 20 is in the state of being suitable for exhaust gas control when the output air-fuel ratio of the downstream air-fuel ratio sensor 42 is the stoichiometric air-fuel ratio. Therefore, if air-fuel ratio control is always executed in consideration of the effect of hydrogen, exhaust emission may be degraded when the state of the catalyst 20 is varied in accordance with the operation state of the internal combustion engine.

Thus, in the present embodiment, when the output air-fuel ratio of the downstream air-fuel ratio sensor 42 is reduced to be equal to or less than a rich-side switching air-fuel ratio that is richer than the stoichiometric air-fuel ratio, the air-fuel ratio control device starts slightly rich control in which the air-fuel ratio of the in-flow exhaust gas is controlled such that the output air-fuel ratio of the downstream air-fuel ratio sensor 42 is maintained at a slightly rich setting air-fuel ratio that is richer than the stoichiometric air-fuel ratio. Consequently, air-fuel ratio control can be performed in consideration of the effect of hydrogen when it is highly likely that hydrogen is flowing out of the catalyst 20. That is, with the present embodiment, it is possible to suppress degradation of exhaust emission by performing air-fuel ratio control in accordance with the situation of generation of hydrogen in the catalyst 20.

In the slightly rich control, the air-fuel ratio control device controls the air-fuel ratio of the in-flow exhaust gas such that the output air-fuel ratio of the downstream air-fuel ratio sensor 42 is varied within a predetermined range centered on the slightly rich setting air-fuel ratio, in order to maintain the output air-fuel ratio of the downstream air-fuel ratio sensor 42 at the slightly rich setting air-fuel ratio. For example, in the slightly rich control, the air-fuel ratio control device sets the target air-fuel ratio for the in-flow exhaust gas to a rich setting air-fuel ratio that is richer than the stoichiometric air-fuel ratio when the output air-fuel ratio of the downstream air-fuel ratio sensor 42 is increased to be equal to or more than a first upper determination air-fuel ratio, and sets the target air-fuel ratio for the in-flow exhaust gas to a lean setting air-fuel ratio that is leaner than the stoichiometric air-fuel ratio when the output air-fuel ratio of the downstream air-fuel ratio sensor 42 is reduced to be equal to or less than a first lower determination air-fuel ratio. The first upper determination air-fuel ratio and the first lower determination air-fuel ratio are determined in advance such that the difference between the first upper determination air-fuel ratio and the slightly rich setting air-fuel ratio is equal to the difference between the first lower determination air-fuel ratio and the slightly rich setting air-fuel ratio and the first upper determination air-fuel ratio is higher (leaner) than the first lower determination air-fuel ratio.

When the catalyst 20 is filled with oxygen because of the effect of disturbance etc. during the slightly rich control, an outflow of hydrogen from the catalyst 20 is ended. Therefore, in the present embodiment, the air-fuel ratio control device ends the slightly rich control when the output air-fuel ratio of the downstream air-fuel ratio sensor 42 is increased to be equal to or more than a lean-side switching air-fuel ratio that is equal to or more than the stoichiometric air-fuel ratio in the slightly rich control. Consequently, the slightly rich control can be ended at an appropriate timing when the outflow of hydrogen from the catalyst 20 is ended.

When the outflow of hydrogen from the catalyst 20 is ended, a deviation in the output from the downstream air-fuel ratio sensor 42 is resolved. Therefore, when the output air-fuel ratio of the downstream air-fuel ratio sensor 42 is increased to be equal to or more than the lean-side switching air-fuel ratio, the air-fuel ratio control device starts stoichiometric air-fuel ratio control in which the air-fuel ratio of the in-flow exhaust gas is controlled such that the output air-fuel ratio of the downstream air-fuel ratio sensor 42 is maintained at the stoichiometric air-fuel ratio. Consequently, it is possible to effectively suppress degradation in exhaust emission when hydrogen is not flowing out of the catalyst 20.

In the stoichiometric air-fuel ratio control, the air-fuel ratio control device controls the air-fuel ratio of the in-flow exhaust gas such that the output air-fuel ratio of the downstream air-fuel ratio sensor 42 is varied within a predetermined range centered on the stoichiometric air-fuel ratio, in order to maintain the output air-fuel ratio of the downstream air-fuel ratio sensor 42 at the stoichiometric air-fuel ratio. For example, in the stoichiometric air-fuel ratio control, the air-fuel ratio control device sets the target air-fuel ratio for the in-flow exhaust gas to a rich setting air-fuel ratio that is richer than the stoichiometric air-fuel ratio when the output air-fuel ratio of the downstream air-fuel ratio sensor 42 is increased to be equal to or more than a second upper determination air-fuel ratio, and sets the target air-fuel ratio for the in-flow exhaust gas to a lean setting air-fuel ratio that is leaner than the stoichiometric air-fuel ratio when the output air-fuel ratio of the downstream air-fuel ratio sensor 42 is reduced to be equal to or less than a second lower determination air-fuel ratio. The second upper determination air-fuel ratio and the second lower determination air-fuel ratio are determined in advance such that the difference between the second upper determination air-fuel ratio and the stoichiometric air-fuel ratio is equal to the difference between the second lower determination air-fuel ratio and the stoichiometric air-fuel ratio and the second upper determination air-fuel ratio is higher (leaner) than the second lower determination air-fuel ratio.

Thus, in the present embodiment, the air-fuel ratio control device executes the slightly rich control since the output air-fuel ratio of the downstream air-fuel ratio sensor 42 is reduced to be equal to or less than the rich-side switching air-fuel ratio until the output air-fuel ratio of the downstream air-fuel ratio sensor 42 is increased to be equal to or more than the lean-side switching air-fuel ratio. Meanwhile, the air-fuel ratio control device executes the stoichiometric air-fuel ratio control since the output air-fuel ratio of the downstream air-fuel ratio sensor 42 is increased to be equal to or more than the lean-side switching air-fuel ratio until the output air-fuel ratio of the downstream air-fuel ratio sensor 42 is reduced to be equal to or less than the rich-side switching air-fuel ratio.

Figure 6:
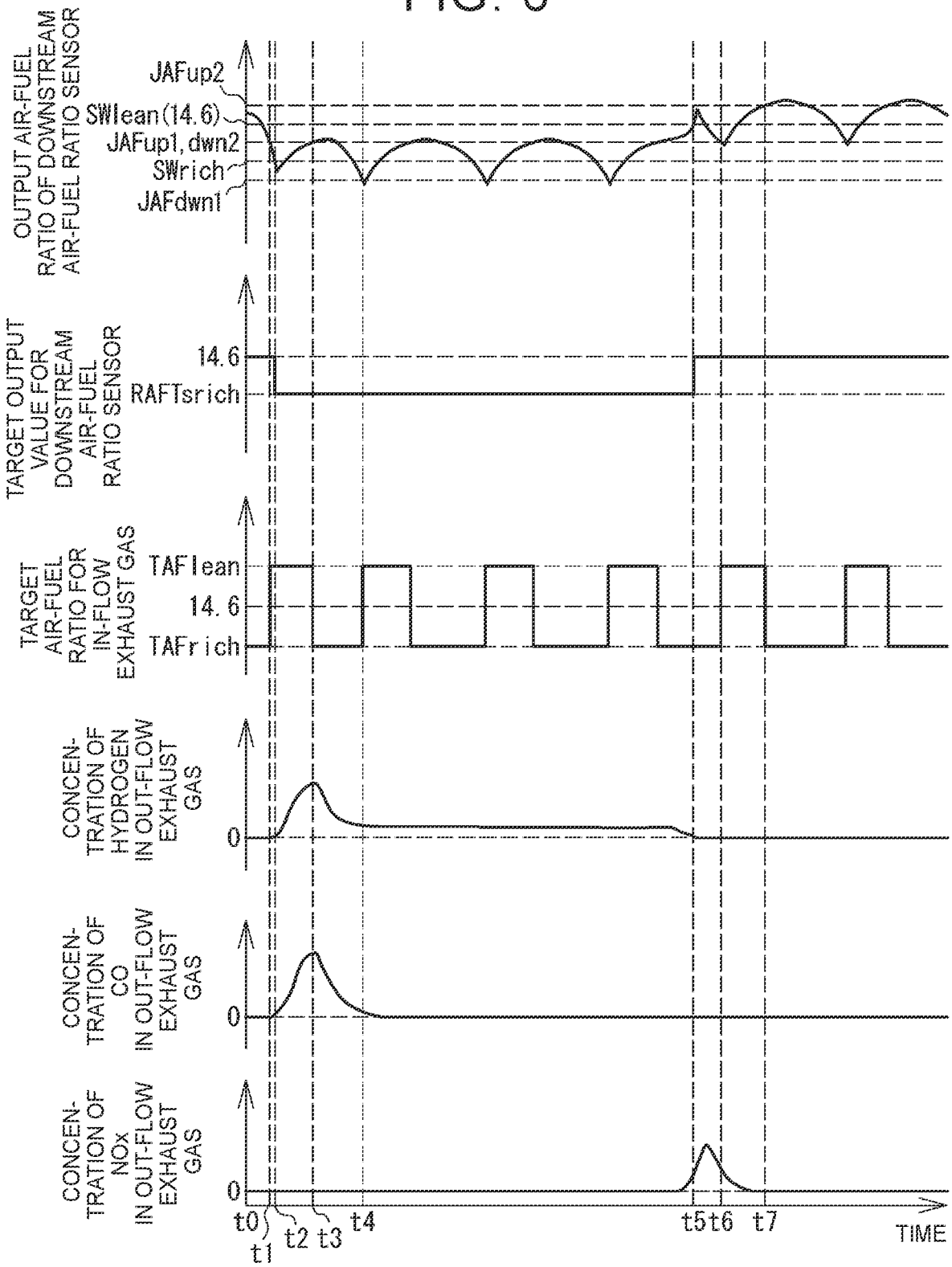
FIG. 6 is a time chart of various parameters at the time when air-fuel ratio control according to a first embodiment of the present disclosure is executed.
Figure 7A:
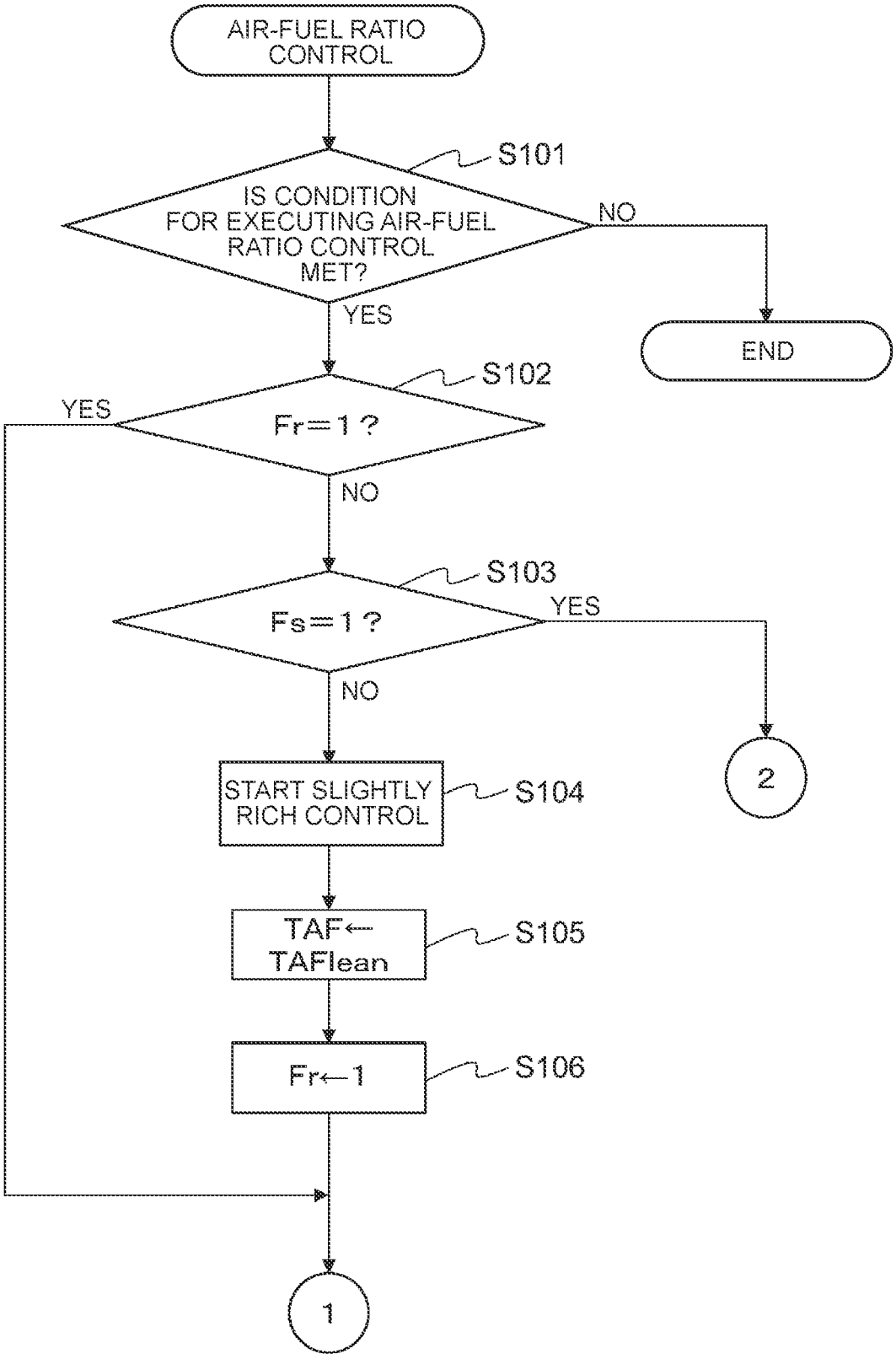
FIG. 7A is a flowchart illustrating a control routine of the air-fuel ratio control according to the first embodiment.
Figure 7B:
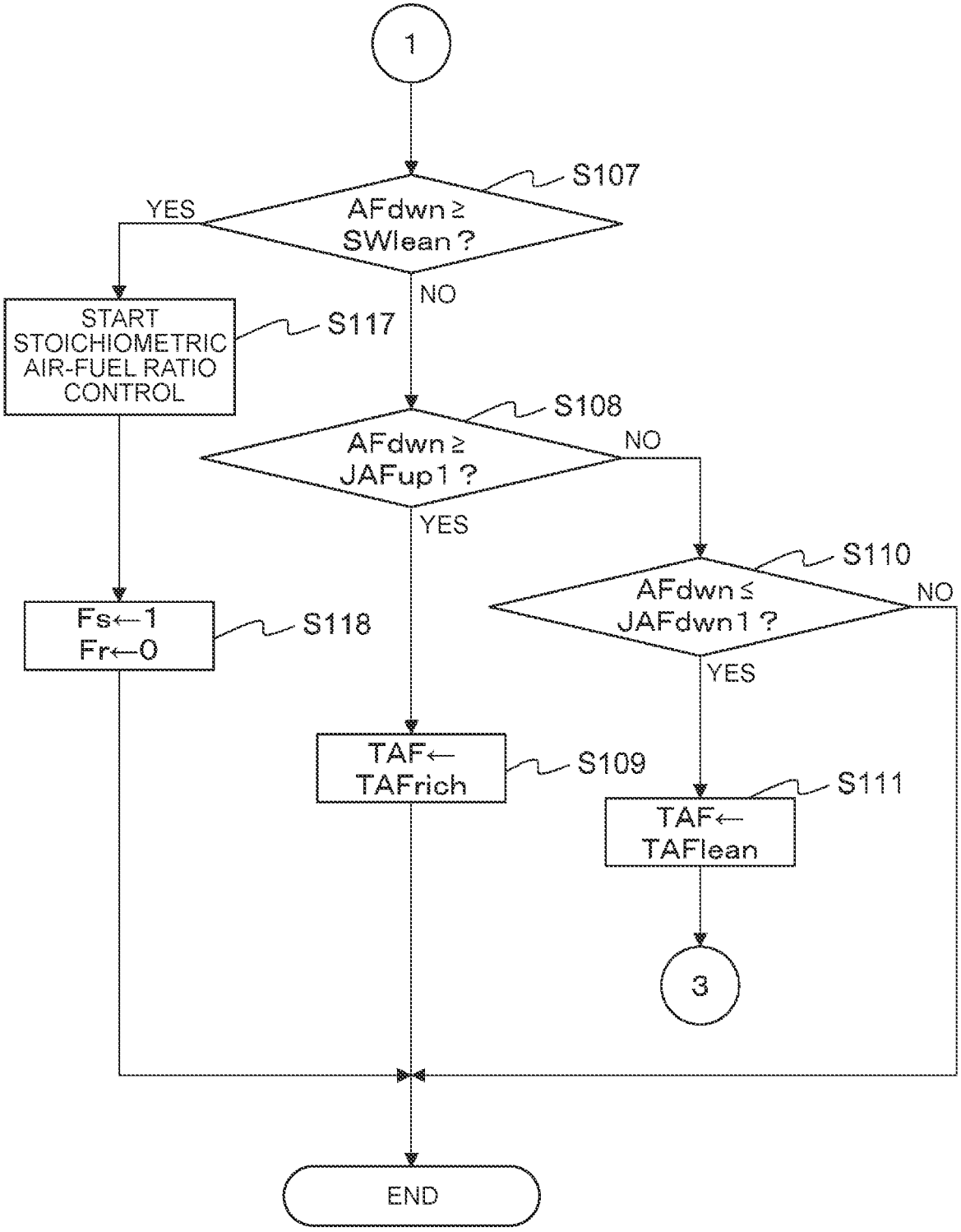
FIG. 7B is a flowchart illustrating the control routine of the air-fuel ratio control according to the first embodiment.
Figure 7C:
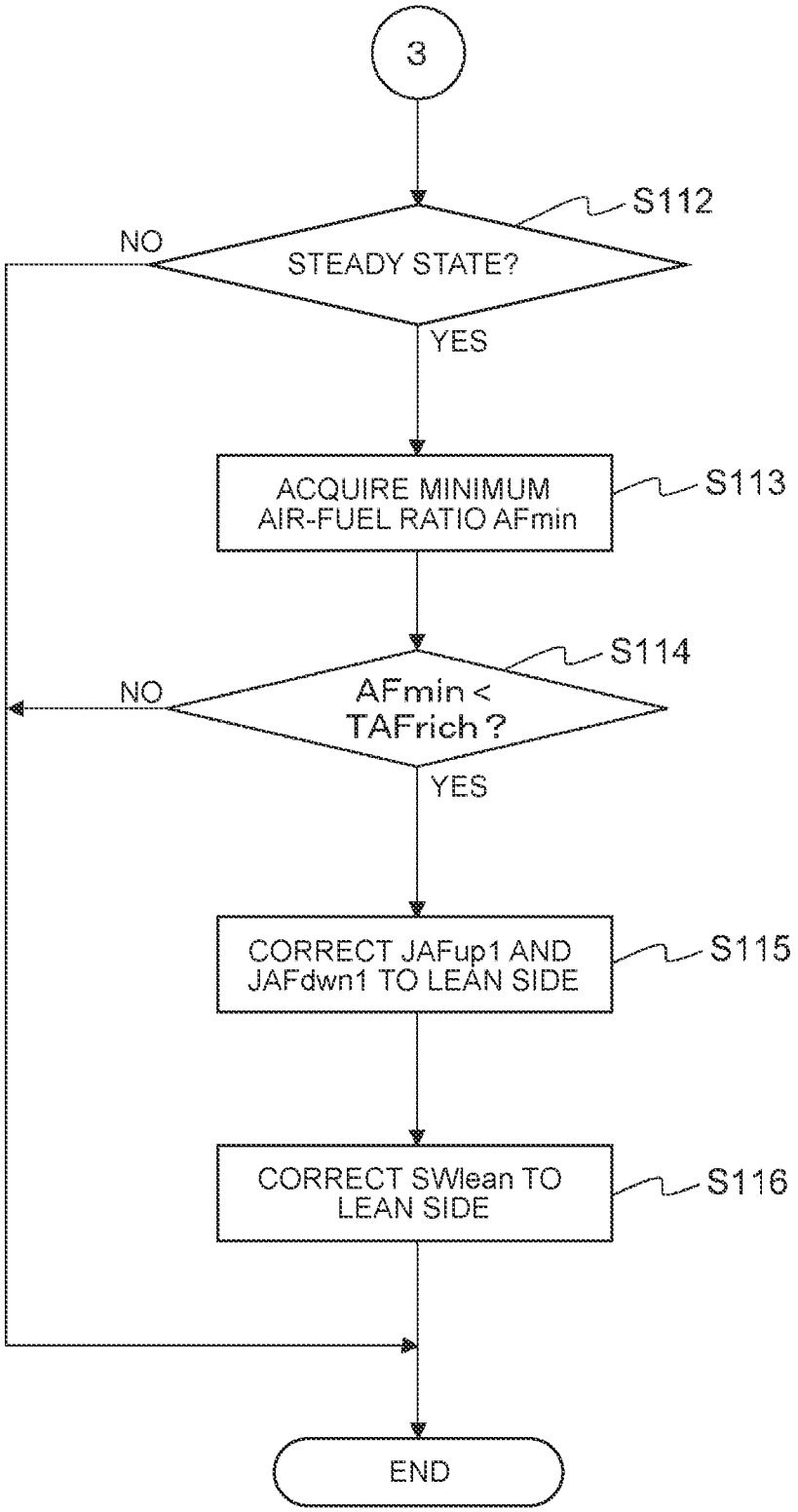
FIG. 7C is a flowchart illustrating the control routine of the air-fuel ratio control according to the first embodiment.
Figure 7D:
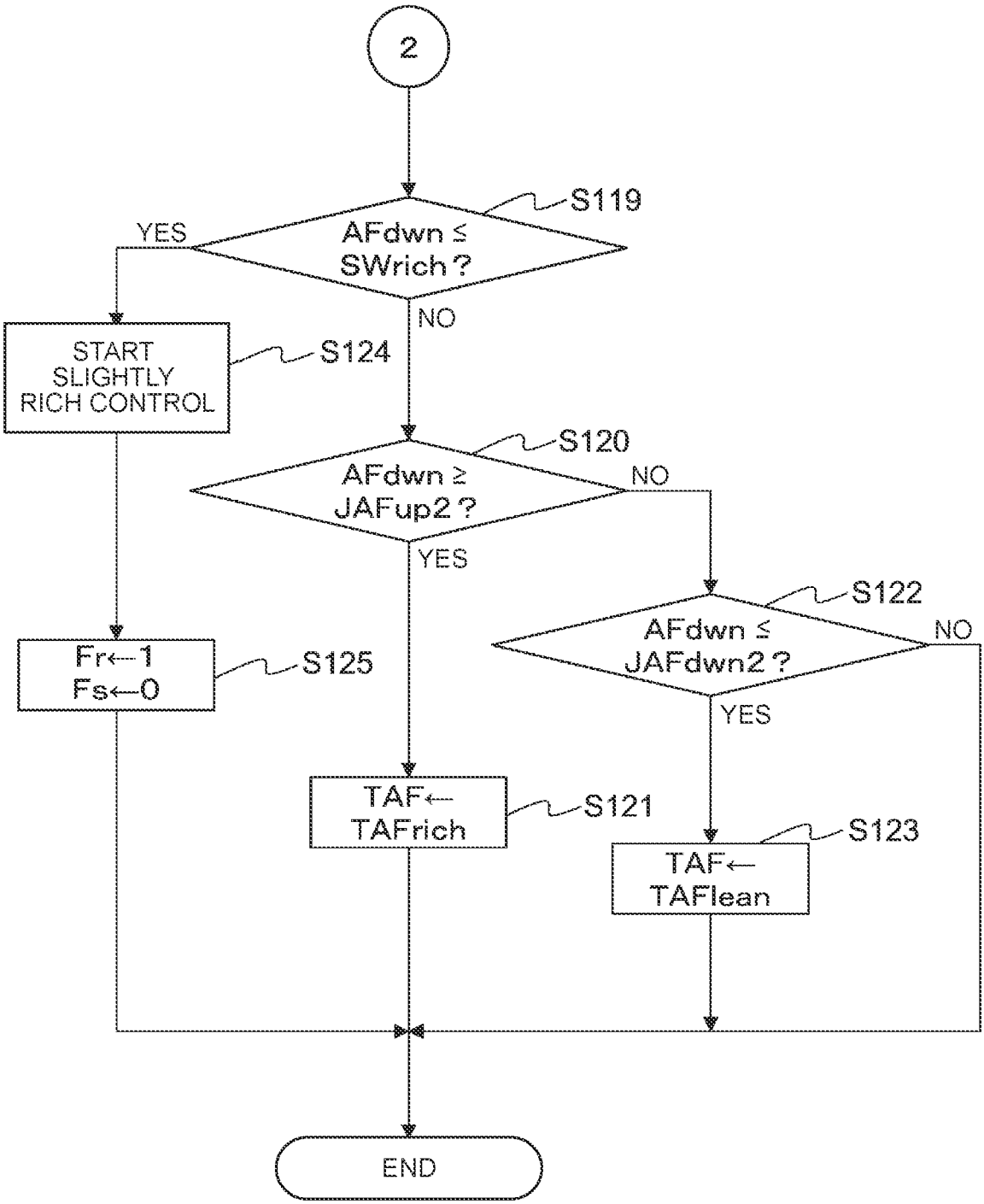
FIG. 7D is a flowchart illustrating the control routine of the air-fuel ratio control according to the first embodiment.

Next, the air-fuel ratio control will be described with reference to a time chart. The air-fuel ratio control discussed above is specifically described with reference to FIG. 6. FIG. 6 is a time chart of various parameters at the time when the air-fuel ratio control according to the first embodiment of the present disclosure is executed. FIG. 6 indicates, as the parameters, the output air-fuel ratio of the downstream air-fuel ratio sensor 42, the target output value for the downstream air-fuel ratio sensor 42, the target air-fuel ratio for the in-flow exhaust gas, the concentration of hydrogen in the out-flow exhaust gas, the concentration of CO in the out-flow exhaust gas, and the concentration of NOx in the out-flow exhaust gas.

In the example in FIG. 6, at time t0, the stoichiometric air-fuel ratio control is executed, and the target output value for the downstream air-fuel ratio sensor 42 is set to the stoichiometric air-fuel ratio (14.6). In the stoichiometric air-fuel ratio control, at time t0, the target air-fuel ratio for the in-flow exhaust gas is set to the rich setting air-fuel ratio TAFrich which is richer than the stoichiometric air-fuel ratio. Therefore, at and after time t0, the output air-fuel ratio of the downstream air-fuel ratio sensor 42 is gradually reduced. When the output air-fuel ratio of the downstream air-fuel ratio sensor 42 reaches a second lower determination air-fuel ratio JAFdwn2 at time t1, the target air-fuel ratio for the in-flow exhaust gas is set to the lean setting air-fuel ratio TAFlean which is leaner than the stoichiometric air-fuel ratio.

In the example in FIG. 6, at time t2, the output air-fuel ratio of the downstream air-fuel ratio sensor 42 has reached a rich-side switching air-fuel ratio SWrich because of the effect of disturbance etc. although the target air-fuel ratio for the in-flow exhaust gas is set to the lean setting air-fuel ratio TAFlean in the stoichiometric air-fuel ratio control. That is, in the stoichiometric air-fuel ratio control, the output air-fuel ratio of the downstream air-fuel ratio sensor 42 is reduced from a value that is equal to or more than the stoichiometric air-fuel ratio to the rich-side switching air-fuel ratio SWrich. Therefore, at time t2, the stoichiometric air-fuel ratio control is ended, and the slightly rich control is started. That is, the target output value for the downstream air-fuel ratio sensor 42 is switched from the stoichiometric air-fuel ratio to a slightly rich setting air-fuel ratio RAFTsrich that is richer than the stoichiometric air-fuel ratio.

When the output air-fuel ratio of the downstream air-fuel ratio sensor 42 is reduced toward the rich-side switching air-fuel ratio SWrich, oxygen in the catalyst 20 is depleted, and hydrogen and CO flow out of the catalyst 20. As a result, an exhaust gas containing hydrogen flows into the downstream air-fuel ratio sensor 42, and a deviation is caused in the output from the downstream air-fuel ratio sensor 42. However, by starting the slightly rich control at time t2, it is possible to bring the catalyst 20 into the state of being suitable for exhaust gas control, and to effectively suppress an outflow of CO and NOx at and after time t2.

After time t2, when the output air-fuel ratio of the downstream air-fuel ratio sensor 42 reaches a first upper determination air-fuel ratio JAFup1 at time t3, the target air-fuel ratio for the in-flow exhaust gas is switched from the lean setting air-fuel ratio TAFlean to the rich setting air-fuel ratio TAFrich in the slightly rich control. In the example in FIG. 6, the value of the first upper determination air-fuel ratio JAFup1 is equal to the value of the second lower determination air-fuel ratio JAFdwn2.

After time t3, when the output air-fuel ratio of the downstream air-fuel ratio sensor 42 reaches a first lower determination air-fuel ratio JAFdwn1 at time t4, the target air-fuel ratio for the in-flow exhaust gas is switched from the rich setting air-fuel ratio TAFrich to the lean setting air-fuel ratio TAFlean in the slightly rich control. Also after that, the target air-fuel ratio for the in-flow exhaust gas is switched in the same manner between the rich setting air-fuel ratio TAFrich and the lean setting air-fuel ratio TAFlean based on the output air-fuel ratio of the downstream air-fuel ratio sensor 42 in the slightly rich control.

In the example in FIG. 6, at time t5, the output air-fuel ratio of the downstream air-fuel ratio sensor 42 has reached a lean-side switching air-fuel ratio SWlean (14.6 in the example in FIG. 6) because of the effect of disturbance etc. although the target air-fuel ratio for the in-flow exhaust gas is set to the rich setting air-fuel ratio TAFrich in the slightly rich control. Therefore, at time t5, the slightly rich control is ended, and the stoichiometric air-fuel ratio control is started. That is, the target output value for the downstream air-fuel ratio sensor 42 is switched from the slightly rich setting air-fuel ratio RAFTsrich to the stoichiometric air-fuel ratio.

When the output air-fuel ratio of the downstream air-fuel ratio sensor 42 is increased toward the lean-side switching air-fuel ratio SWlean, the catalyst 20 is filled with oxygen, and NOx flows out of the catalyst 20. As a result, an outflow of hydrogen from the catalyst 20 is ended, and the deviation in the output from the downstream air-fuel ratio sensor 42 is resolved. However, by starting the stoichiometric air-fuel ratio control at time t5, it is possible to bring the catalyst 20 into the state of being suitable for exhaust gas control, and to effectively suppress an outflow of CO and NOx at and after time t5.

After time t5, when the output air-fuel ratio of the downstream air-fuel ratio sensor 42 reaches the second lower determination air-fuel ratio JAFdwn2 at time t6, the target air-fuel ratio for the in-flow exhaust gas is switched from the rich setting air-fuel ratio TAFrich to the lean setting air-fuel ratio TAFlean in the stoichiometric air-fuel ratio control. After time t6, when the output air-fuel ratio of the downstream air-fuel ratio sensor 42 reaches a second upper determination air-fuel ratio JAFup2 at time t7, the target air-fuel ratio for the in-flow exhaust gas is switched from the lean setting air-fuel ratio TAFlean to the rich setting air-fuel ratio TAFrich in the stoichiometric air-fuel ratio control. Also after that, the target air-fuel ratio for the in-flow exhaust gas is switched in the same manner between the rich setting air-fuel ratio TAFrich and the lean setting air-fuel ratio TAFlean based on the output air-fuel ratio of the downstream air-fuel ratio sensor 42 in the stoichiometric air-fuel ratio control.

Next, correction of the air-fuel ratio control will be described. As described above, the air-fuel ratio control device alternately executes the air-fuel ratio reduction control, in which the target air-fuel ratio for the in-flow exhaust gas is set to a rich setting air-fuel ratio that is richer than the stoichiometric air-fuel ratio, and the air-fuel ratio increase control, in which the target air-fuel ratio for the in-flow exhaust gas is set to a lean setting air-fuel ratio that is leaner than the stoichiometric air-fuel ratio, based on the output from the downstream air-fuel ratio sensor 42 in each of the slightly rich control and the stoichiometric air-fuel ratio control. Specifically, when the slightly rich control is executed, the air-fuel ratio control device starts the air-fuel ratio increase control when the output air-fuel ratio of the downstream air-fuel ratio sensor 42 is reduced to be equal to or less than the first lower determination air-fuel ratio in the air-fuel ratio reduction control, and starts the air-fuel ratio reduction control when the output air-fuel ratio of the downstream air-fuel ratio sensor 42 is increased to be equal to or more than the first upper determination air-fuel ratio in the air-fuel ratio increase control. Meanwhile, when the stoichiometric air-fuel ratio control is executed, the air-fuel ratio control device starts the air-fuel ratio increase control when the output air-fuel ratio of the downstream air-fuel ratio sensor 42 is reduced to be equal to or less than the first lower determination air-fuel ratio in the air-fuel ratio reduction control, and starts the air-fuel ratio reduction control when the output air-fuel ratio of the downstream air-fuel ratio sensor 42 is increased to be equal to or more than the first upper determination air-fuel ratio in the air-fuel ratio increase control.

As described above, the effect of hydrogen supplied from the catalyst 20 to the downstream air-fuel ratio sensor 42 can be reduced by executing the slightly rich control when hydrogen is generated in the catalyst 20. However, a deviation is caused in the output from the downstream air-fuel ratio sensor 42 because of aging degradation, individual variations, etc., as a result of which an excessive amount of a reducing gas, that is, an excessive amount of HC and CO, may be supplied to the catalyst 20. In this case, excessive hydrogen may be generated in the catalyst 20, and the effect of hydrogen may not be effectively reduced through the slightly rich control.

Therefore, when excessive hydrogen is generated in the catalyst, it is desirable to reduce the amount of generated hydrogen by correcting the air-fuel ratio control. Normally, when no significant deviation is caused in the output from the downstream air-fuel ratio sensor 42, the output from the downstream air-fuel ratio sensor 42 does not indicate a value that is richer than the air-fuel ratio of the in-flow exhaust gas. Thus, when the output from the downstream air-fuel ratio sensor 42 indicates a value that is richer than the air-fuel ratio of the in-flow exhaust gas, it is highly possible that excessive hydrogen is generated in the catalyst 20 when the output air-fuel ratio of the downstream air-fuel ratio sensor 42 is reduced to a value that is richer than the target air-fuel ratio (rich setting air-fuel ratio) in the air-fuel ratio reduction control through the air-fuel ratio reduction control, for example.

Thus, in the present embodiment, when the minimum air-fuel ratio, which is obtained when the output air-fuel ratio of the downstream air-fuel ratio sensor 42 is varied to the rich side through the air-fuel ratio reduction control, is richer than the rich setting air-fuel ratio, the air-fuel ratio control device corrects parameters related to the air-fuel ratio reduction control such that the amount of a reducing gas supplied to the catalyst 20 is decreased in the air-fuel ratio reduction control, that is, the amount of HC supplied to the catalyst 20 is decreased in the air-fuel ratio reduction control. Consequently, it is possible to suppress excessive generation of hydrogen in the catalyst 20. The minimum air-fuel ratio (AFmin) means the value (output peak value) of the lowest point obtained when the output air-fuel ratio of the downstream air-fuel ratio sensor 42 is varied to the rich side, as indicated in the time chart of the output air-fuel ratio of the downstream air-fuel ratio sensor 42 in FIG. 5A.

When the stoichiometric air-fuel ratio control is performed as the air-fuel ratio control, it is less likely that excessive hydrogen is generated in the catalyst 20. Therefore, the air-fuel ratio control device corrects the parameters related to the air-fuel ratio reduction control when the slightly rich control is executed. For example, the air-fuel ratio control device corrects the parameters related to the air-fuel ratio reduction control by correcting the first lower determination air-fuel ratio and the first upper determination air-fuel ratio to the lean side. Consequently, it is possible to decrease the amount of the reducing gas supplied to the catalyst 20 in the air-fuel ratio reduction control, and hence to decrease the amount of hydrogen generated in the catalyst 20. When the first lower determination air-fuel ratio and the first upper determination air-fuel ratio are corrected to the lean side, the target output value for the downstream air-fuel ratio sensor 42 in the slightly rich control is also corrected to the lean side.

When the output from the downstream air-fuel ratio sensor 42 is unstable because of the effect of temporary disturbance etc., it is difficult to perform an appropriate correction. Therefore, in the present embodiment, the air-fuel ratio control device corrects the parameters related to the air-fuel ratio reduction control when the operation state of the internal combustion engine is steady. Consequently, it is possible to suppress an inappropriate correction from being performed based on less reliable data.

Next, the flowcharts of the air-fuel ratio control will be described. The air-fuel ratio control discussed above will be described in detail below with reference to the flowcharts in FIGS. 7A to 7D. FIGS. 7A to 7D are flowcharts illustrating the control routine of the air-fuel ratio control according to the first embodiment. The present control routine is repeatedly executed by the ECU 31 that functions as the air-fuel ratio control device.

First, in step S101, the air-fuel ratio control device determines whether a condition for executing the air-fuel ratio control is met. The condition for executing the air-fuel ratio control is met when the temperature of the catalyst 20 is equal to or more than a predetermined activation temperature and the element temperature of the upstream air-fuel ratio sensor 41 and the downstream air-fuel ratio sensor 42 is equal to or more than a predetermined activation temperature, for example. The temperature of the catalyst 20 is calculated based on an output from a temperature sensor provided in the catalyst 20 or the exhaust passage in the vicinity of the catalyst 20, or calculated based on a predetermined state quantity of the internal combustion engine (e.g. engine coolant temperature, intake air amount, engine load, etc.), for example. The element temperature of the upstream air-fuel ratio sensor 41 and the downstream air-fuel ratio sensor 42 is calculated based on the impedance of a sensor element, for example. The condition for executing the air-fuel ratio control may be met when a predetermined time has elapsed since the internal combustion engine is started, when a predetermined component (such as the fuel injection valve 11, the catalyst 20, the upstream air-fuel ratio sensor 41, or the downstream air-fuel ratio sensor 42) of the internal combustion engine is normal, etc.

When it is determined in step S101 that the condition for executing the air-fuel ratio control is not met, the present control routine is ended. When it is determined in step S101 that the condition for executing the air-fuel ratio control is met, on the other hand, the present control routine proceeds to step S102.

In step S102, the air-fuel ratio control device determines whether a rich flag Fr is set to 1. The rich flag Fr is a flag that is set to 1 when the slightly rich control is started, and that is set to zero when the slightly rich control is ended. The initial value of the rich flag Fr at the time when the internal combustion engine is started is zero. When it is determined in step S102 that the rich flag Fr is set to zero, the present control routine proceeds to step S103.

In step S103, the air-fuel ratio control device determines whether a stoichiometric flag Fs is set to 1. The stoichiometric flag Fs is a flag that is set to 1 when the stoichiometric air-fuel ratio control is started, and that is set to zero when the stoichiometric air-fuel ratio control is ended. The initial value of the stoichiometric flag Fs at the time when the internal combustion engine is started is zero. When it is determined in step S103 that the stoichiometric flag Fs is set to zero, the present control routine proceeds to step S104.

In step S104, the air-fuel ratio control device starts the slightly rich control. That is, the air-fuel ratio control device sets the target output value for the downstream air-fuel ratio sensor 42 to the slightly rich setting air-fuel ratio. The slightly rich setting air-fuel ratio is set to an air-fuel ratio that is determined in advance and that is slightly richer than the stoichiometric air-fuel ratio. The slightly rich setting air-fuel ratio is set to 14.50 to 14.58, preferably 14.58, for example.

Then, in step S105, the air-fuel ratio control device sets a target air-fuel ratio TAF for the in-flow exhaust gas to the lean setting air-fuel ratio TAFlean. That is, the air-fuel ratio control device starts the air-fuel ratio increase control in the slightly rich control. In the air-fuel ratio increase control, the air-fuel ratio control device performs feedback control in which the air-fuel ratio of the in-flow exhaust gas is brought to the lean setting air-fuel ratio TAFlean based on the output from the upstream air-fuel ratio sensor 41. The lean setting air-fuel ratio TAFlean is set to an air-fuel ratio (e.g. 14.7 to 15.7) that is determined in advance and that is leaner than the stoichiometric air-fuel ratio.

Then, in step S106, the air-fuel ratio control device sets the rich flag Fr to 1, and the present control routine proceeds to step S107. When the slightly rich control has already been executed at the time of start of the control routine, on the other hand, it is determined in step S102 that the rich flag Fr is set to 1, and the present control routine proceeds to step S107 by skipping steps S103 to S106.

In step S107, the air-fuel ratio control device determines whether an output air-fuel ratio AFdwn of the downstream air-fuel ratio sensor 42 is equal to or more than the lean-side switching air-fuel ratio SWlean. The lean-side switching air-fuel ratio SWlean is set to a value that is determined in advance and that is equal to or more than the stoichiometric air-fuel ratio. The lean-side switching air-fuel ratio SWlean is set to 14.60 to 14.65, preferably set to the stoichiometric air-fuel ratio (14.60), for example. When it is determined in step S107 that the output air-fuel ratio AFdwn of the downstream air-fuel ratio sensor 42 is less than the lean-side switching air-fuel ratio SWlean, the present control routine proceeds to step S108, and the slightly rich control is continued.

In step S108, the air-fuel ratio control device determines whether the output air-fuel ratio AFdwn of the downstream air-fuel ratio sensor 42 is equal to or more than the first upper determination air-fuel ratio JAFup1. The first upper determination air-fuel ratio JAFup1 is set to an air-fuel ratio that is determined in advance and that is richer than the stoichiometric air-fuel ratio and slightly leaner than the slightly rich setting air-fuel ratio. The first upper determination air-fuel ratio JAFup1 is set to a value that is more than the slightly rich setting air-fuel ratio by 0.01, and set to 14.59 when the slightly rich setting air-fuel ratio is 14.58, for example.

When it is determined in step S108 that the output air-fuel ratio AFdwn of the downstream air-fuel ratio sensor 42 is equal to or more than the first upper determination air-fuel ratio JAFup1, the present control routine proceeds to step S109. In step S109, the air-fuel ratio control device sets the target air-fuel ratio TAF for the in-flow exhaust gas to the rich setting air-fuel ratio TAFrich. That is, the air-fuel ratio control device starts the air-fuel ratio reduction control in the slightly rich control. In the air-fuel ratio reduction control, the air-fuel ratio control device performs feedback control in which the air-fuel ratio of the in-flow exhaust gas is brought to the rich setting air-fuel ratio TAFrich based on the output from the upstream air-fuel ratio sensor 41. The rich setting air-fuel ratio TAFrich is set to an air-fuel ratio (e.g. 13.5 to 14.5) that is determined in advance and that is richer than the stoichiometric air-fuel ratio. After step S109, the present control routine is ended.

When it is determined in step S108 that the output air-fuel ratio AFdwn of the downstream air-fuel ratio sensor 42 is less than the first upper determination air-fuel ratio JAFup1, on the other hand, the present control routine proceeds to step S110. In step S110, the air-fuel ratio control device determines whether the output air-fuel ratio AFdwn of the downstream air-fuel ratio sensor 42 is equal to or less than the first lower determination air-fuel ratio JAFdwn1. The first lower determination air-fuel ratio JAFdwn1 is set to an air-fuel ratio that is determined in advance and that is slightly richer than the slightly rich setting air-fuel ratio. The first lower determination air-fuel ratio JAFdwn1 is set to a value that is less than the slightly rich setting air-fuel ratio by 0.01, and set to 14.57 when the slightly rich setting air-fuel ratio is 14.58, for example.

When it is determined in step S110 that the output air-fuel ratio AFdwn of the downstream air-fuel ratio sensor 42 is more than the first lower determination air-fuel ratio JAFdwn1, the present control routine is ended, and the target air-fuel ratio TAF for the in-flow exhaust gas is maintained at the present set value. When it is determined in step S110 that the output air-fuel ratio AFdwn of the downstream air-fuel ratio sensor 42 is equal to or less than the first lower determination air-fuel ratio JAFdwn1, on the other hand, the present control routine proceeds to step S111.

In step S111, the air-fuel ratio control device sets the target air-fuel ratio TAF for the in-flow exhaust gas to the lean setting air-fuel ratio TAFlean. That is, the air-fuel ratio control device ends the air-fuel ratio reduction control and starts the air-fuel ratio increase control in the slightly rich control.

Then, in step S112, the air-fuel ratio control device determines whether the operation state of the internal combustion engine is steady. For example, the air-fuel ratio control device determines that the operation state of the internal combustion engine is steady when the amount of variation in a predetermined operation parameter of the internal combustion engine is equal to or less than a predetermined value. Examples of the predetermined operation parameter include the intake air amount, the engine rotational speed, the fuel injection amount, the engine load, etc. The intake air amount is calculated based on the output from the air flow meter 40. The engine rotational speed is calculated based on the output from the crank angle sensor 45. The fuel injection amount is calculated based on the value of an instruction from the ECU 31 to the fuel injection valve 11. The engine load is calculated based on the output from the load sensor 44. When it is determined in step S1, 12 that the operation state of the internal combustion engine is not steady, the present control routine is ended.

When it is determined in step S112 that the operation state of the internal combustion engine is steady, on the other hand, the present control routine proceeds to step S113. In step S113, the air-fuel ratio control device acquires the minimum air-fuel ratio AFmin obtained when the output air-fuel ratio AFdwn of the downstream air-fuel ratio sensor 42 is reduced to be equal to or less than the first lower determination air-fuel ratio JAFdwn1 through the air-fuel ratio reduction control.

Then, in step S114, the air-fuel ratio control device makes a comparison between the minimum air-fuel ratio AFmin acquired in step S113 and the rich setting air-fuel ratio TAFrich, which is the target air-fuel ratio in the air-fuel ratio reduction control, to determine whether it is necessary to correct the parameters related to the air-fuel ratio reduction control. Specifically, the air-fuel ratio control device determines whether the minimum air-fuel ratio AFmin is less than the rich setting air-fuel ratio TAFrich, that is, whether the minimum air-fuel ratio AFmin is richer than the rich setting air-fuel ratio TAFrich. When it is determined in step S114 that the minimum air-fuel ratio AFmin is equal to or more than the rich setting air-fuel ratio TAFrich, the present control routine is ended.

When it is determined in step S114 that the minimum air-fuel ratio AFmin is richer than the rich setting air-fuel ratio TAFrich, on the other hand, the present control routine proceeds to step S115. In step S115, the air-fuel ratio control device corrects the first upper determination air-fuel ratio JAFup1 and the first lower determination air-fuel ratio JAFdwn1 to the lean side. For example, the air-fuel ratio control device corrects the first upper determination air-fuel ratio JAFup1 and the first lower determination air-fuel ratio JAFdwn1 to the lean side by adding a predetermined slight value (e.g. 0.001 to 0.01) to each of the first upper determination air-fuel ratio JAFup1 and the first lower determination air-fuel ratio JAFdwn1. The air-fuel ratio control device may add a value that is proportional to the difference between the rich setting air-fuel ratio TAFrich and the minimum air-fuel ratio AFmin, in place of the predetermined slight value, to each of the first upper determination air-fuel ratio JAFup1 and the first lower determination air-fuel ratio JAFdwn1.

An upper limit value of the first upper determination air-fuel ratio JAFup1 and the first lower determination air-fuel ratio JAFdwn1 may be determined in advance, and the air-fuel ratio control device may correct the first upper determination air-fuel ratio JAFup1 and the first lower determination air-fuel ratio JAFdwn1 in the range of the upper limit value or less. Consequently, it is possible to suppress the air-fuel ratio control from becoming unstable because of excessive correction.

After step S115 and in step S116, the air-fuel ratio control device corrects the lean-side switching air-fuel ratio SWlean to the lean side in accordance with the amount of correction of the first upper determination air-fuel ratio JAFup1 such that the first upper determination air-fuel ratio JAFup1 does not become equal to or more than the lean-side switching air-fuel ratio SWlean. For example, the air-fuel ratio control device also adds the value added to the first upper determination air-fuel ratio JAFup1 through the correction to the lean-side switching air-fuel ratio SWlean. After step S116, the present control routine is ended.

When it is determined in step S107 that the output air-fuel ratio AFdwn of the downstream air-fuel ratio sensor 42 is equal to or more than the lean-side switching air-fuel ratio SWlean, on the other hand, the present control routine proceeds to step S117. In step S117, the air-fuel ratio control device ends the slightly rich control and starts the stoichiometric air-fuel ratio control. That is, the air-fuel ratio control device sets the target output value for the downstream air-fuel ratio sensor 42 to the stoichiometric air-fuel ratio (14.60).

Then, in step S118, the air-fuel ratio control device sets the stoichiometric flag Fs to 1, and sets the rich flag Fr to zero. After step S118, the present control routine is ended. In this case, it is determined in step S103 of the next control routine that the stoichiometric flag Fs is set to 1, and the present control routine proceeds to step S119.

In step S119, the air-fuel ratio control device determines whether the output air-fuel ratio AFdwn of the downstream air-fuel ratio sensor 42 is equal to or less than the rich-side switching air-fuel ratio SWrich. The rich-side switching air-fuel ratio SWrich is set to a value that is determined in advance and that is richer than the stoichiometric air-fuel ratio. For example, the rich-side switching air-fuel ratio SWrich is set to 14.50 to 14.58, preferably set to a value (e.g. 14.58) that is equal to the slightly rich setting air-fuel ratio. When it is determined in step S119 that the output air-fuel ratio AFdwn of the downstream air-fuel ratio sensor 42 is more than the rich-side switching air-fuel ratio SWrich, the present control routine proceeds to step S120, and the stoichiometric air-fuel ratio control is continued.

In step S120, the air-fuel ratio control device determines whether the output air-fuel ratio AFdwn of the downstream air-fuel ratio sensor 42 is equal to or more than the second upper determination air-fuel ratio JAFup2. The second upper determination air-fuel ratio JAFup2 is set to an air-fuel ratio that is determined in advance and that is slightly leaner than the stoichiometric air-fuel ratio. The second upper determination air-fuel ratio JAFup2 is set to a value (14.61) that is more than the stoichiometric air-fuel ratio by 0.01, for example.

When it is determined in step S120 that the output air-fuel ratio AFdwn of the downstream air-fuel ratio sensor 42 is equal to or more than the second upper determination air-fuel ratio JAFup2, the present control routine proceeds to step S121. In step S121, the air-fuel ratio control device sets the target air-fuel ratio TAF for the in-flow exhaust gas to the rich setting air-fuel ratio TAFrich. That is, the air-fuel ratio control device starts the air-fuel ratio reduction control in the stoichiometric air-fuel ratio control. After step S121, the present control routine is ended.

When it is determined in step S120 that the output air-fuel ratio AFdwn of the downstream air-fuel ratio sensor 42 is less than the second upper determination air-fuel ratio JAFup2, on the other hand, the present control routine proceeds to step S122. In step S122, the air-fuel ratio control device determines whether the output air-fuel ratio AFdwn of the downstream air-fuel ratio sensor 42 is equal to or less than the second lower determination air-fuel ratio JAFdwn2. The second lower determination air-fuel ratio JAFdwn2 is set to an air-fuel ratio that is determined in advance and that is slightly richer than the stoichiometric air-fuel ratio. The second upper determination air-fuel ratio JAFup2 is set to a value (14.59) that is less than the stoichiometric air-fuel ratio by 0.01, for example.

When it is determined in step S122 that the output air-fuel ratio AFdwn of the downstream air-fuel ratio sensor 42 is more than the second lower determination air-fuel ratio JAFdwn2, the present control routine is ended, and the target air-fuel ratio TAF for the in-flow exhaust gas is maintained at the present set value. When it is determined in step S122 that the output air-fuel ratio AFdwn of the downstream air-fuel ratio sensor 42 is equal to or less than the second lower determination air-fuel ratio JAFdwn2, on the other hand, the present control routine proceeds to step S123.

In step S123, the air-fuel ratio control device sets the target air-fuel ratio TAF for the in-flow exhaust gas to the lean setting air-fuel ratio TAFlean. That is, the air-fuel ratio control device ends the air-fuel ratio reduction control and starts the air-fuel ratio increase control in the stoichiometric air-fuel ratio control. After step S123, the present control routine is ended.

When it is determined in step S119 that the output air-fuel ratio AFdwn of the downstream air-fuel ratio sensor 42 is equal to or less than the rich-side switching air-fuel ratio SWrich, on the other hand, the present control routine proceeds to step S124. In step S124, the air-fuel ratio control device ends the stoichiometric air-fuel ratio control and starts the slightly rich control. That is, the air-fuel ratio control device sets the target output value for the downstream air-fuel ratio sensor 42 to the slightly rich setting air-fuel ratio.

Then, in step S125, the air-fuel ratio control device sets the rich flag Fr to 1, and sets the stoichiometric flag Fs to zero. After step S125, the present control routine is ended.

In step S1, 14, the air-fuel ratio control device may determine whether it is necessary to correct the parameters related to the air-fuel ratio reduction control using an average value of detected air-fuel ratios of the in-flow exhaust gas in the air-fuel ratio reduction control, that is, an average value of air-fuel ratios detected by the upstream air-fuel ratio sensor 41 during execution of the air-fuel ratio reduction control, in place of the rich setting air-fuel ratio TAFrich. In this case, in step S114, the air-fuel ratio control device determines whether the minimum air-fuel ratio AFmin is richer than the average value of the detected air-fuel ratios of the in-flow exhaust gas in the air-fuel ratio reduction control.

In step S115, the air-fuel ratio control device may correct only the first lower determination air-fuel ratio JAFdwn1 to the lean side. In step S115, the air-fuel ratio control device may correct the target air-fuel ratio for the in-flow exhaust gas in the air-fuel ratio reduction control, that is, the rich setting air-fuel ratio TAFrich, to the lean side. In this case, the air-fuel ratio control device reduces the degree of richness (difference from the stoichiometric air-fuel ratio) of the rich setting air-fuel ratio TAFrich through correction. That is, the air-fuel ratio control device may correct the parameters related to the air-fuel ratio reduction control by correcting the first lower determination air-fuel ratio JAFdwn1 or the rich setting air-fuel ratio TAFrich to the lean side. In this case, step S116 is omitted.

In at least one of steps S108 and S120, the air-fuel ratio control device may determine whether the elapsed time, the integral intake air amount, etc. since the target air-fuel ratio TAF for the in-flow exhaust gas is set to the lean setting air-fuel ratio TAFlean has reached a predetermined threshold. That is, in at least one of the slightly rich control and the stoichiometric air-fuel ratio control, the air-fuel ratio control device may switch the target air-fuel ratio TAF for the in-flow exhaust gas from the lean setting air-fuel ratio TAFlean to the rich setting air-fuel ratio TAFrich when the elapsed time, the integral intake air amount, etc. since the target air-fuel ratio TAF for the in-flow exhaust gas is set to the lean setting air-fuel ratio TAFlean has reached the predetermined threshold.

In at least one of steps S110 and S122, the air-fuel ratio control device may determine whether the elapsed time, the integral intake air amount, etc. since the target air-fuel ratio TAF for the in-flow exhaust gas is set to the rich setting air-fuel ratio TAFrich has reached a predetermined threshold. That is, in at least one of the slightly rich control and the stoichiometric air-fuel ratio control, the air-fuel ratio control device may switch the target air-fuel ratio TAF for the in-flow exhaust gas from the rich setting air-fuel ratio TAFrich to the lean setting air-fuel ratio TAFlean when the elapsed time, the integral intake air amount, etc. since the target air-fuel ratio TAF for the in-flow exhaust gas is set to the rich setting air-fuel ratio TAFrich has reached the predetermined threshold. When the control described above is executed in the slightly rich control, the air-fuel ratio control device corrects the parameters related to the air-fuel ratio reduction control by reducing the above threshold or correcting the rich setting air-fuel ratio TAFrich to the lean side, for example.

It is considered that the amount of oxygen occluded in the catalyst 20 has not reached the maximum value when the internal combustion engine is started. Therefore, in the control routine described above, the slightly rich control is executed as the initial air-fuel ratio control after the internal combustion engine is started. However, the stoichiometric air-fuel ratio control may be executed as the initial air-fuel ratio control after the internal combustion engine is started. The air-fuel ratio control device may perform feedback control of the air-fuel ratio of the in-flow exhaust gas based on the output from the upstream air-fuel ratio sensor 41 such that the air-fuel ratio of the in-flow exhaust gas coincides with a predetermined value (e.g. the stoichiometric air-fuel ratio) as the initial air-fuel ratio control after the internal combustion engine is started. In this case, the slightly rich control is started when the output air-fuel ratio AFdwn of the downstream air-fuel ratio sensor 42 is reduced to be equal to or less than the rich-side switching air-fuel ratio SWrich in the initial air-fuel ratio control, and the stoichiometric air-fuel ratio control is started when the output air-fuel ratio AFdwn of the downstream air-fuel ratio sensor 42 is increased to be equal to or more than the lean-side switching air-fuel ratio SWlean in the initial air-fuel ratio control.

Next, a second embodiment of the present disclosure will be described. The configuration and the control of the exhaust gas control apparatus according to the second embodiment are basically the same as those of the exhaust gas control apparatus according to the first embodiment except for the points described below. Therefore, the second embodiment of the present disclosure will be described below mainly for differences from the first embodiment.

By correcting the parameters related to the air-fuel ratio reduction control as described above, it is possible to bring the amount of the reducing gas supplied to the catalyst 20 closer to an appropriate amount, and to suppress excessive generation of hydrogen in the catalyst 20. When the air-fuel ratio of the in-flow exhaust gas is controlled such that the output air-fuel ratio of the downstream air-fuel ratio sensor 42 is varied in the range between the first lower determination air-fuel ratio and the first upper determination air-fuel ratio in the slightly rich control, however, the state of the catalyst 20 may temporarily deviate from the state that is optimal for exhaust gas control. In order to meet strict exhaust gas regulations while reducing the size and the cost of the catalyst 20, it is required to maintain the state of the catalyst 20 in the state of being optimal for exhaust gas control as much as possible.

As discussed above, when the air-fuel ratio reduction control is ended and the air-fuel ratio increase control is started in the slightly rich control, the output air-fuel ratio of the downstream air-fuel ratio sensor 42 has a value that is richer than the stoichiometric air-fuel ratio. Normally, when an exhaust gas with an air-fuel ratio that is leaner than the stoichiometric air-fuel ratio passes through the catalyst 20 and reaches the downstream air-fuel ratio sensor 42 after the air-fuel ratio increase control is started, the output air-fuel ratio of the downstream air-fuel ratio sensor 42 is varied to the lean side. Therefore, when the output air-fuel ratio of the downstream air-fuel ratio sensor 42 is not varied to the lean side at an appropriate timing after the air-fuel ratio increase control is started, it is highly likely that the air-fuel ratio control in the slightly rich control is not optimized.

Thus, in the second embodiment, when the output air-fuel ratio of the downstream air-fuel ratio sensor 42 is not varied to the lean side during a period since the air-fuel ratio increase control is started until a predetermined threshold time elapses, the air-fuel ratio control device corrects the first upper determination air-fuel ratio and the first lower determination air-fuel ratio such that the difference between the first upper determination air-fuel ratio and the first lower determination air-fuel ratio becomes small. Consequently, it is possible to bring the state of the catalyst 20 at the time when the slightly rich control is executed closer to the state of being optimal for exhaust gas control, and hence to further suppress degradation of exhaust emission.

Figure 8:
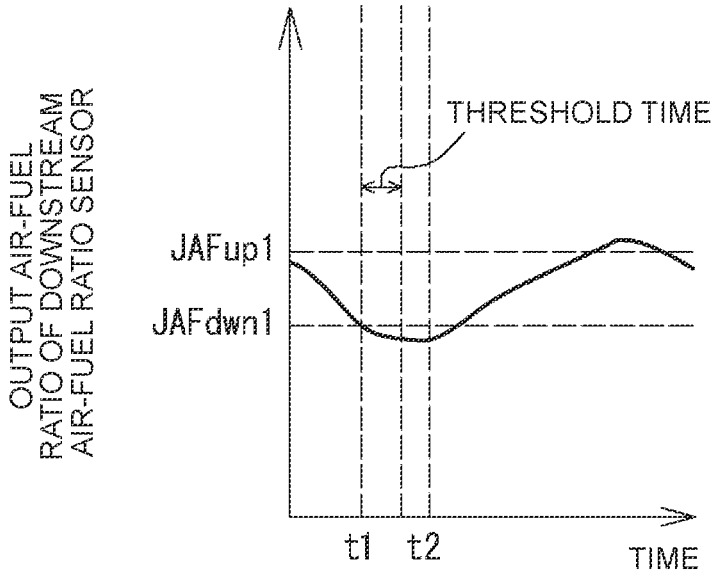
FIG. 8 illustrates an example of the waveform of an output air-fuel ratio of the downstream air-fuel ratio sensor at the time when slightly rich control is executed in the internal combustion engine.
Figure 9A:
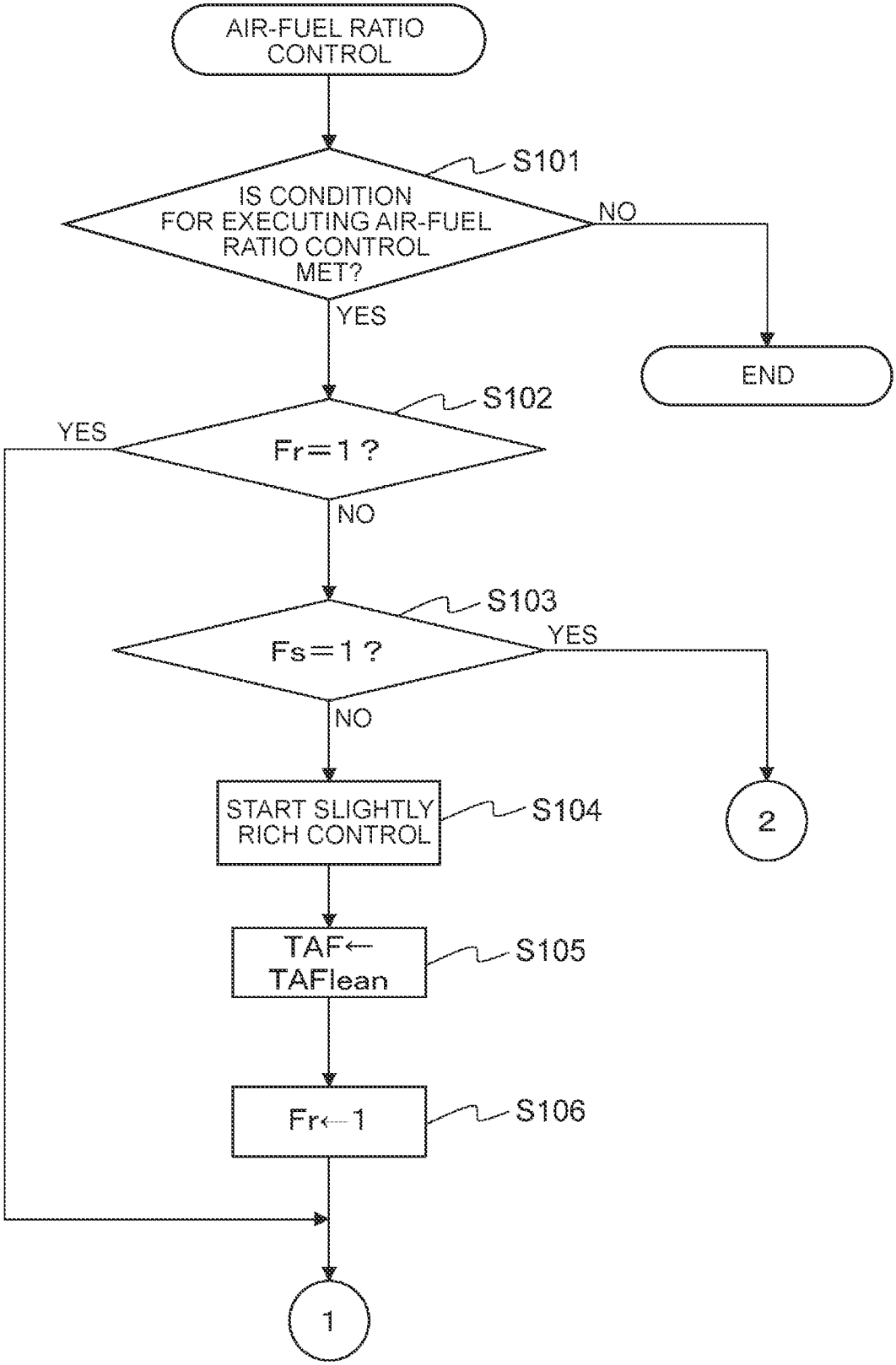
FIG. 9A is a flowchart illustrating a control routine of air-fuel ratio control according to a second embodiment of the present disclosure.
Figure 9B:
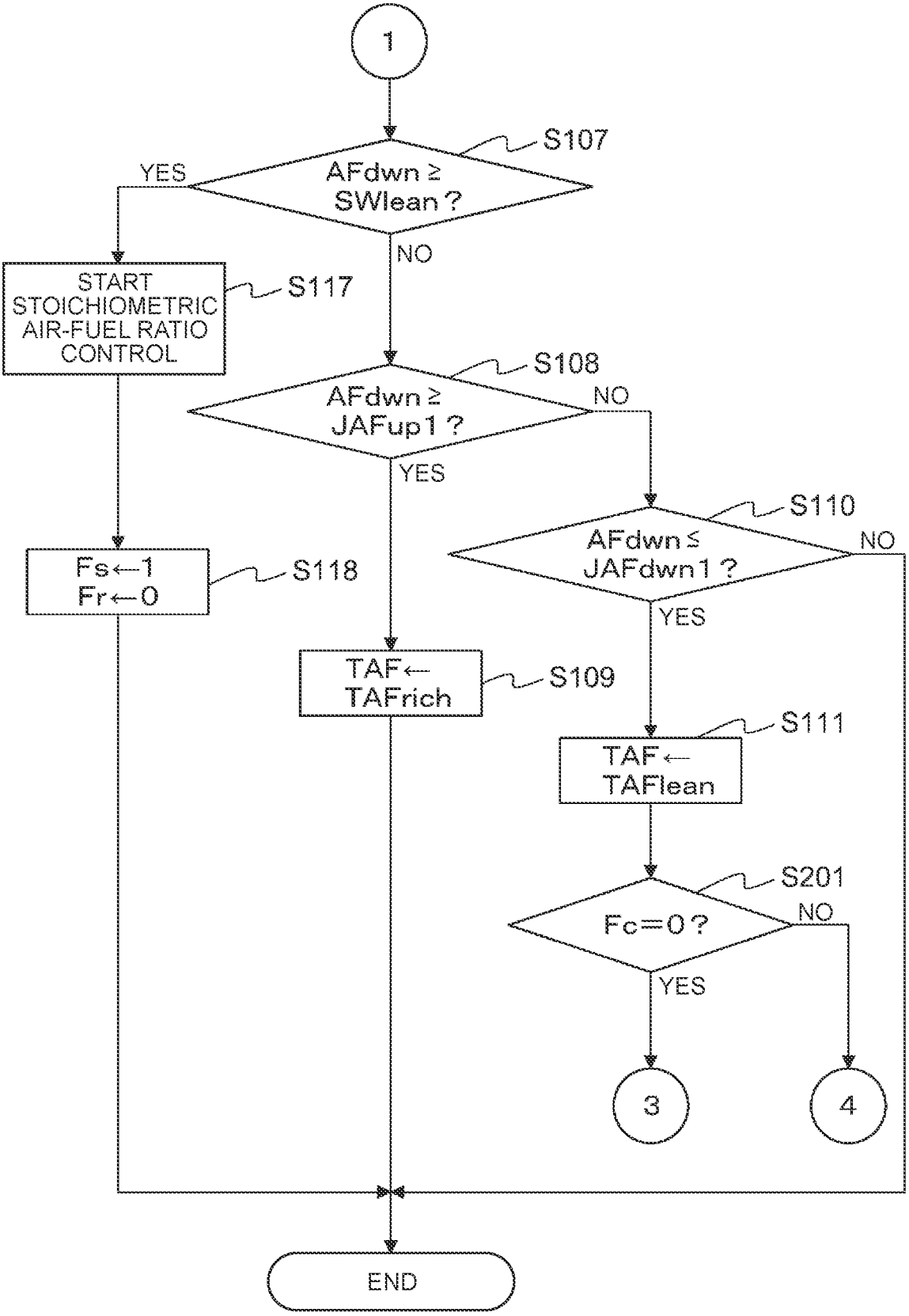
FIG. 9B is a flowchart illustrating the control routine of the air-fuel ratio control according to the second embodiment.
Figure 9C:
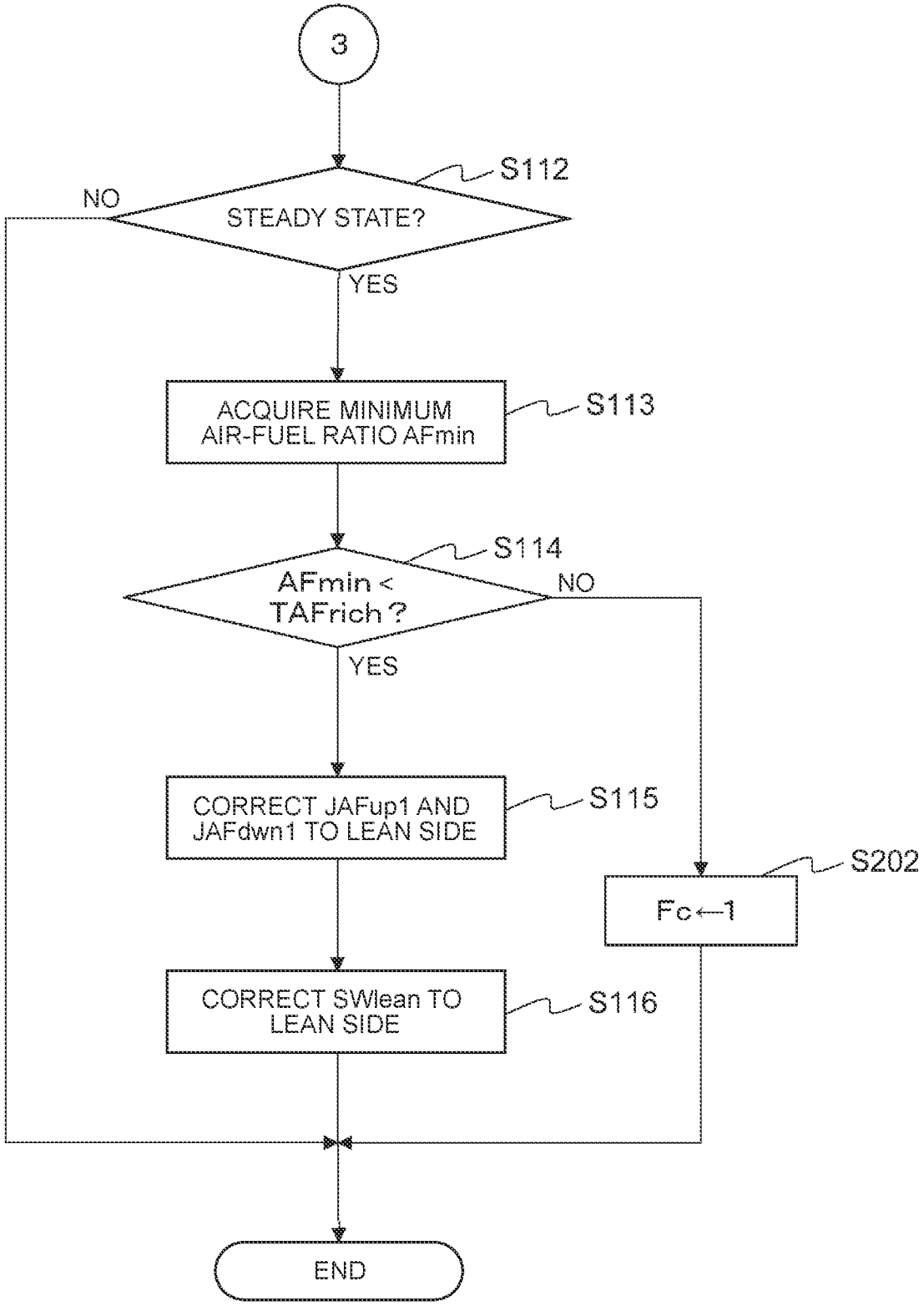
FIG. 9C is a flowchart illustrating the control routine of the air-fuel ratio control according to the second embodiment.
Figure 9D:
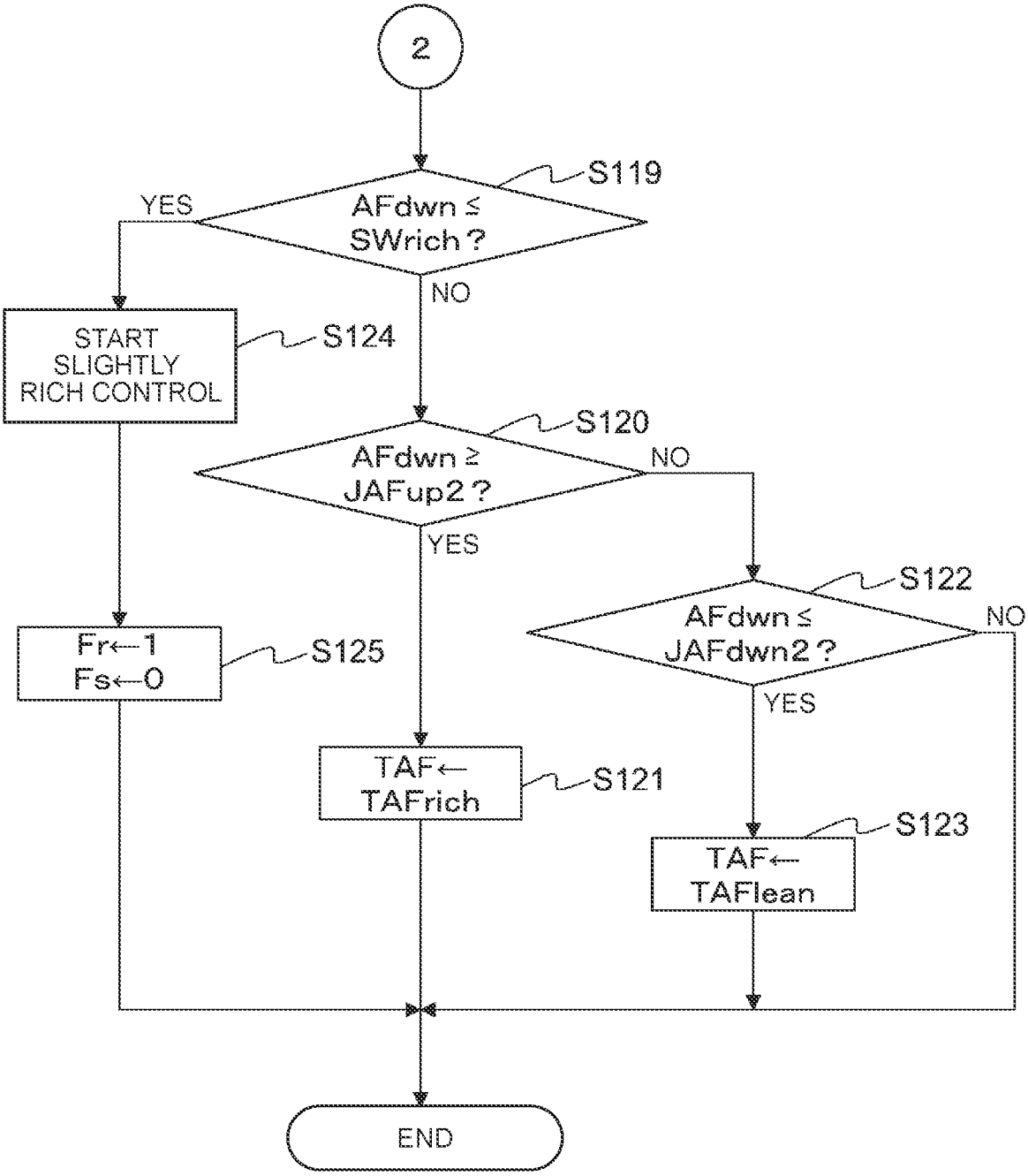
FIG. 9D is a flowchart illustrating the control routine of the air-fuel ratio control according to the second embodiment.
Figure 9E:
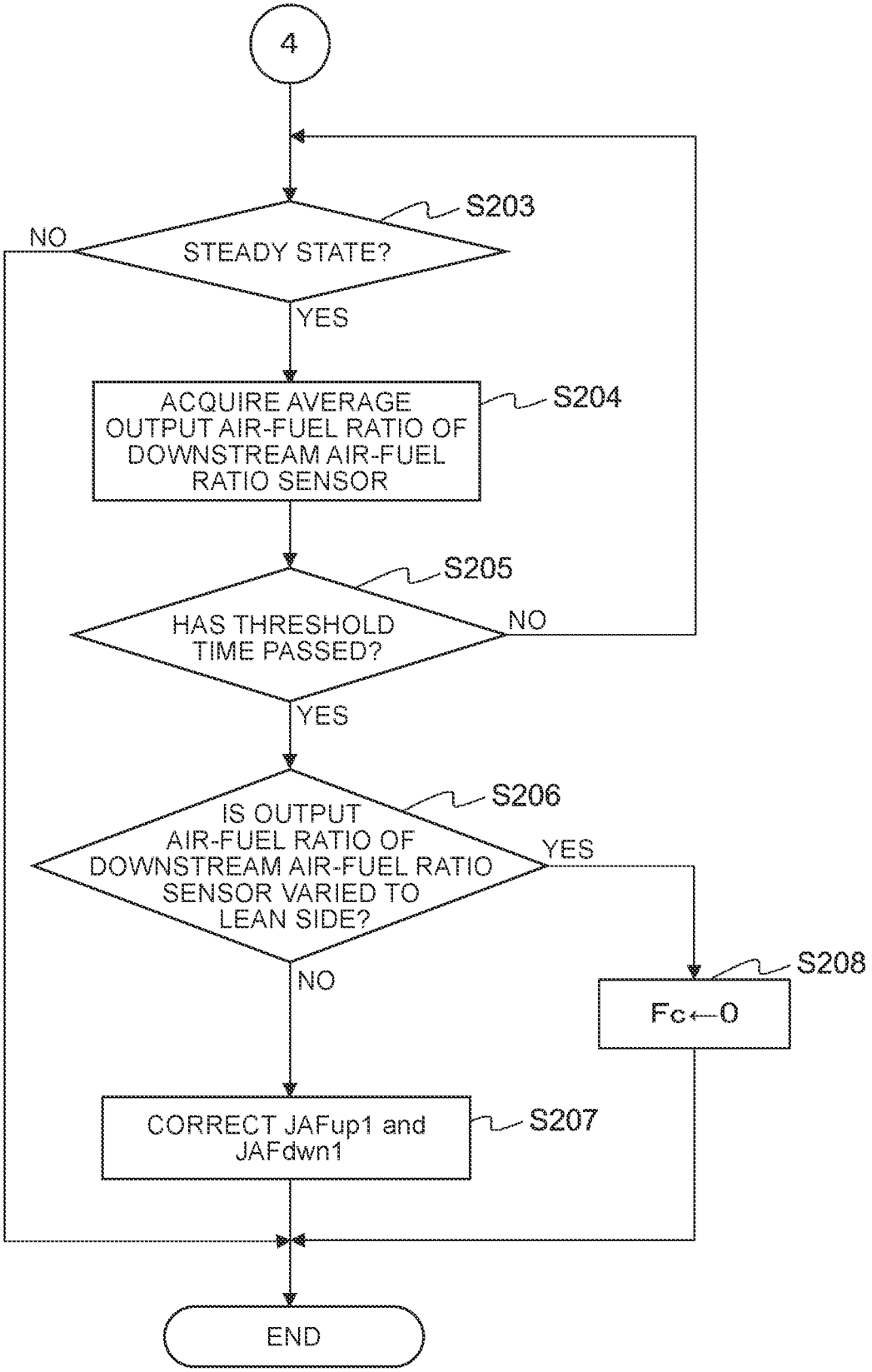
FIG. 9E is a flowchart illustrating the control routine of the air-fuel ratio control according to the second embodiment.

FIG. 8 illustrates an example of the waveform of the output air-fuel ratio of the downstream air-fuel ratio sensor 42 at the time when the slightly rich control is executed. In the example in FIG. 8, the output air-fuel ratio of the downstream air-fuel ratio sensor 42 reaches the first lower determination air-fuel ratio JAFdwn1 and the air-fuel ratio increase control is started at time t1, and the output air-fuel ratio of the downstream air-fuel ratio sensor 42 starts being varied to the lean side through the air-fuel ratio increase control at time t2 which follows time t1. The time since time t1 to time t2 is longer than the threshold time corresponding to the time required for the exhaust gas discharged from the cylinders to reach the downstream air-fuel ratio sensor 42. Therefore, in such a case, the first upper determination air-fuel ratio and the first lower determination air-fuel ratio are corrected such that the difference between the first upper determination air-fuel ratio and the first lower determination air-fuel ratio becomes small.

FIGS. 9A to 9E are flowcharts illustrating the control routine of the air-fuel ratio control according to the second embodiment. The present control routine is repeatedly executed by the ECU 31 that functions as the air-fuel ratio control device.

Steps S101 to S111 are executed in the same manner as in the first embodiment. In step S111, as discussed above, the air-fuel ratio reduction control is ended and the air-fuel ratio increase control is started in the slightly rich control. In the second embodiment, in step S201 which follows step S111, the air-fuel ratio control device determines whether the correction flag Fc is set to zero. The initial value of the correction flag Fc at the time when the internal combustion engine is started is zero.

When it is determined in step S201 that the correction flag Fc is set to zero, the present control routine proceeds to step S112. Steps S112 to S116 are executed in the same manner as in the first embodiment. When it is determined in step S114 that the minimum air-fuel ratio is equal to or more than the rich setting air-fuel ratio TAFrich, the present control routine proceeds to step S202.

In this case, it is considered that an appropriate amount of a reducing gas is supplied to the catalyst 20 in the slightly rich control, and the air-fuel ratio control device sets the correction flag Fc to 1 in step S202. After step S202, the present control routine is ended.

When it is determined in step S201 that the correction flag Fc is set to 1, on the other hand, the present control routine proceeds to step S203. In step S203, as in step S112, the air-fuel ratio control device determines whether the operation state of the internal combustion engine is steady. When it is determined that the operation state of the internal combustion engine is not steady, the present control routine is ended. When it is determined that the operation state of the internal combustion engine is steady, on the other hand, the present control routine proceeds to step S204.

In step S204, the air-fuel ratio control device acquires an average output air-fuel ratio of the downstream air-fuel ratio sensor 42 for a predetermined time (e.g. 10 ms to 100 ms). The currently acquired average output air-fuel ratio and the last acquired average output air-fuel ratio are stored in a memory (e.g. the RAM 33) of the ECU 31.

Then, in step S205, the air-fuel ratio control device determines whether a predetermined threshold time has elapsed since the air-fuel ratio increase control is started. The threshold time is determined in advance as the time required for the exhaust gas discharged from the cylinders to reach the downstream air-fuel ratio sensor 42, and set to 200 ms, for example. When it is determined in step S205 that the threshold time has not elapsed, the present control routine returns to step S203, and steps S203 and S204 are executed again.

When it is determined in step S205 that the threshold time has elapsed, on the other hand, the present control routine proceeds to step S206. In step S206, the air-fuel ratio control device compares the two average output air-fuel ratios stored in the memory of the ECU 31, and determines whether the output air-fuel ratio of the downstream air-fuel ratio sensor 42 has been varied to the lean side. Specifically, the air-fuel ratio control device determines that the output air-fuel ratio of the downstream air-fuel ratio sensor 42 has been varied to the lean side when the currently acquired average output air-fuel ratio is leaner than the last acquired average output air-fuel ratio.

When it is determined in step S206 that the output air-fuel ratio of the downstream air-fuel ratio sensor 42 has not been varied to the lean side, the present control routine proceeds to step S207. In step S207, the air-fuel ratio control device corrects the first upper determination air-fuel ratio JAFup1 and the first lower determination air-fuel ratio JAFdwn1 such that the difference between the first upper determination air-fuel ratio JAFup1 and the first lower determination air-fuel ratio JAFdwn1 becomes small.

For example, the air-fuel ratio control device corrects the first upper determination air-fuel ratio JAFup1 to the rich side by subtracting a predetermined slight value (e.g. 0.001 to 0.01) from the first upper determination air-fuel ratio JAFup1, and corrects the first lower determination air-fuel ratio JAFdwn1 to the lean side by adding the predetermined slight value to the first lower determination air-fuel ratio JAFdwn1. A lower limit value of the first upper determination air-fuel ratio JAFup1 and an upper limit value of the first lower determination air-fuel ratio JAFdwn1 may be determined in advance, and the air-fuel ratio control device may correct the first upper determination air-fuel ratio JAFup1 in the range of the lower limit value or less and correct the first lower determination air-fuel ratio JAFdwn1 in the range of the upper limit value or less. Consequently, it is possible to suppress the air-fuel ratio control from becoming unstable because of excessive correction. After step S207, the present control routine is ended.

When it is determined in step S206 that the output air-fuel ratio of the downstream air-fuel ratio sensor 42 has been varied to the lean side, on the other hand, the present control routine proceeds to step S208. In step S208, the air-fuel ratio control device resets the correction flag Fe to zero. After step S208, the present control routine is ended.

Steps S117 to S123 are executed in the same manner as in the first embodiment. The present control routine can be modified in the same manner as the control routine in FIGS. 7A to 7D.

Next, a third embodiment of the present disclosure will be described. The configuration and the control of the exhaust gas control apparatus according to the third embodiment are basically the same as those of the exhaust gas control apparatus according to the first embodiment except for the points described below. Therefore, the third embodiment of the present disclosure will be described below mainly for differences from the first embodiment.

The correction of the air-fuel ratio control discussed above in relation to the first embodiment is also applicable to air-fuel ratio control other than the slightly rich control. For example, such correction is applicable to post-recovery rich control executed immediately after fuel cut control.

The air-fuel ratio control device executes fuel cut control in which supply of fuel to the combustion chamber 5 is stopped during operation of the internal combustion engine when a predetermined condition for execution is met. For example, the condition for executing the fuel cut control is met when the amount of depression of the accelerator pedal 43 is zero or substantially zero (i.e. the engine load is zero or substantially zero) and the engine rotational speed is equal to or more than a predetermined rotational speed that is higher than the rotational speed during idling.

When the fuel cut control is executed, air or an exhaust gas that is similar to air is discharged from the cylinders, and therefore a gas with a significantly high air-fuel ratio (i.e. a gas with a significantly high degree of leanness) flows into the catalyst 20. Therefore, when the fuel cut control is continued for a predetermined time or more, the amount of oxygen occluded in the catalyst 20 reaches a maximum value. The catalyst 20 cannot effectively control NOx in the exhaust gas when the amount of occluded oxygen is maximum. Therefore, the air-fuel ratio control device executes post-recovery rich control in which the target air-fuel ratio for the in-flow exhaust gas is set to an air-fuel ratio that is richer than the stoichiometric air-fuel ratio after the fuel cut control is ended.

The post-recovery rich control is composed of first air-fuel ratio reduction control, in which the target air-fuel ratio for the in-flow exhaust gas is set to a first rich setting air-fuel ratio that is richer than the stoichiometric air-fuel ratio, and second air-fuel ratio reduction control, in which the target air-fuel ratio for the in-flow exhaust gas is set to a second rich setting air-fuel ratio that is richer than the stoichiometric air-fuel ratio, and the degree of richness of the first rich setting air-fuel ratio is higher than the degree of richness of the second rich setting air-fuel ratio. In the post-recovery rich control, the first air-fuel ratio reduction control is executed first, and the second air-fuel ratio reduction control is executed thereafter. That is, in the post-recovery rich control, the target air-fuel ratio for the in-flow exhaust gas is switched from the first rich setting air-fuel ratio to the second rich setting air-fuel ratio.

Figure 10:
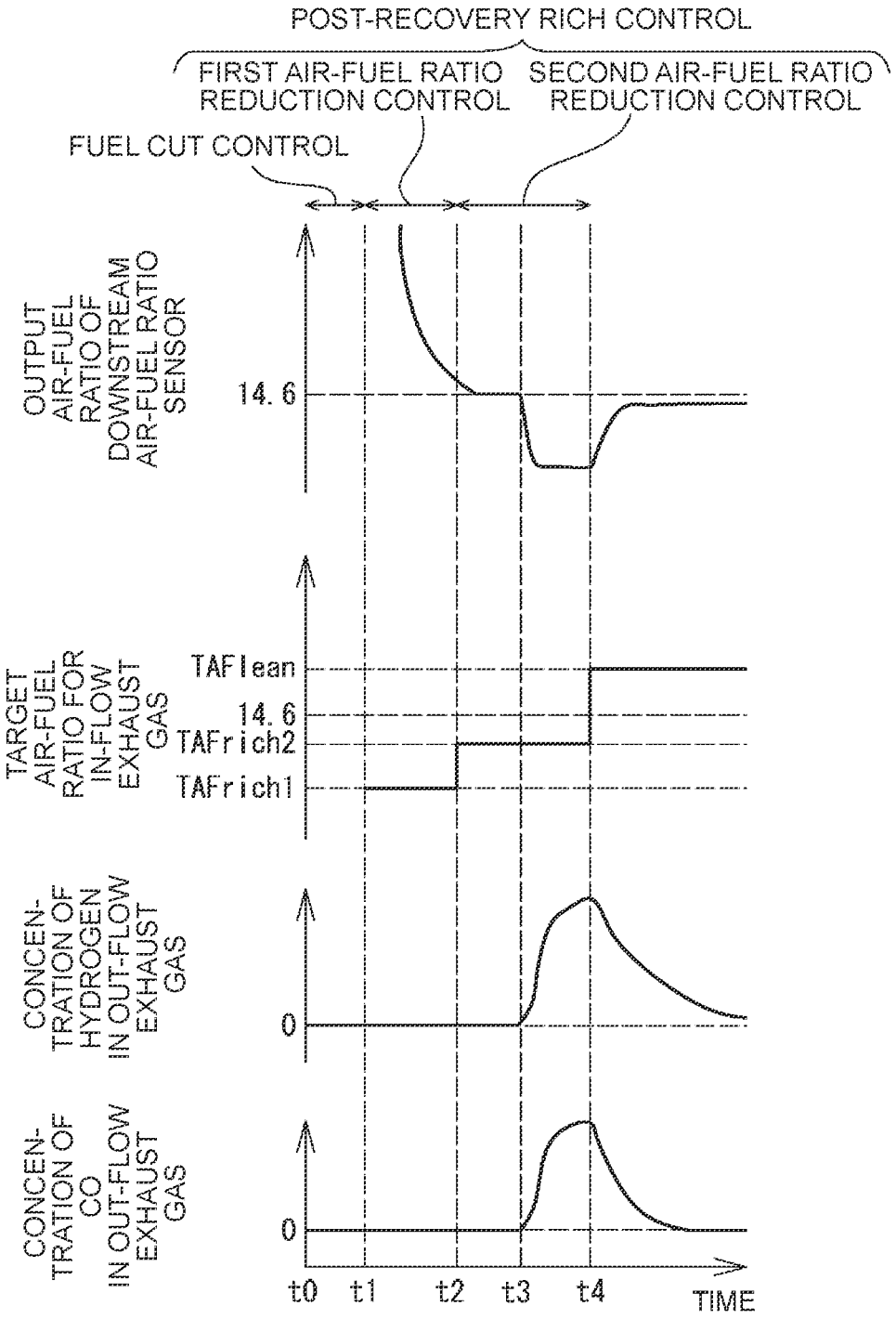
FIG. 10 is a time chart of various parameters at the time when fuel cut control and post-recovery rich control are executed in the internal combustion engine.

FIG. 10 is a time chart of various parameters at the time when the fuel cut control and the post-recovery rich control are executed. FIG. 10 indicates, as the parameters, the output air-fuel ratio of the downstream air-fuel ratio sensor 42, the target air-fuel ratio for the in-flow exhaust gas, the concentration of hydrogen in the out-flow exhaust gas, and the concentration of CO in the out-flow exhaust gas.

In the example in FIG. 10, the fuel cut control is executed from time t0 to time t1, and the post-recovery rich control is started at time t1. In the post-recovery rich control, the first air-fuel ratio reduction control is executed first, and the target air-fuel ratio for the in-flow exhaust gas is set to a first rich setting air-fuel ratio TAFrich1 at time t1. When an exhaust gas with a rich air-fuel ratio flows into the catalyst 20 filled with oxygen through the fuel cut control, the amount of oxygen occluded in the catalyst 20 is gradually decreased. As a result, when the first air-fuel ratio reduction control is executed, the output air-fuel ratio of the downstream air-fuel ratio sensor 42 is gradually reduced toward the stoichiometric air-fuel ratio.

When the first air-fuel ratio reduction control is executed for a predetermined time, the second air-fuel ratio reduction control is started at time t2. That is, the target air-fuel ratio for the in-flow exhaust gas is switched from the first rich setting air-fuel ratio TAFrich1 to a second rich setting air-fuel ratio TAFrich2. In the second air-fuel ratio reduction control, the output air-fuel ratio of the downstream air-fuel ratio sensor 42 is reduced to the stoichiometric air-fuel ratio, and the amount of oxygen occluded in the catalyst 20 becomes substantially zero at time t3. As a result, hydrogen and CO flow out of the catalyst 20, and the output air-fuel ratio of the downstream air-fuel ratio sensor 42 starts being varied to the rich side.

When the second air-fuel ratio reduction control is executed for a predetermined time, the second air-fuel ratio reduction control is ended at time t4, and the target air-fuel ratio for the in-flow exhaust gas is switched from the second rich setting air-fuel ratio TAFrich2 to the lean setting air-fuel ratio TAFlean which is leaner than the stoichiometric air-fuel ratio. In the example in FIG. 10, an excessive amount of a reducing gas is supplied to the catalyst 20 through the post-recovery rich control, as a result of which excessive hydrogen is generated in the catalyst 20. In such a case, it is desirable to reduce the amount of generated hydrogen by correcting control parameters for the post-recovery rich control.

Thus, in the third embodiment, when the minimum air-fuel ratio, which is obtained when the output air-fuel ratio of the downstream air-fuel ratio sensor 42 is varied to the rich side through the second air-fuel ratio reduction control, is richer than the second rich setting air-fuel ratio, the air-fuel ratio control device corrects parameters related to the second air-fuel ratio reduction control such that the amount of the reducing gas supplied to the catalyst 20 in the second air-fuel ratio reduction control is decreased. Consequently, it is possible to suppress excessive generation of hydrogen in the catalyst 20.

For example, the air-fuel ratio control device corrects the parameters related to the air-fuel ratio reduction control by decreasing the time of execution of the second air-fuel ratio reduction control. Consequently, it is possible to decrease the amount of the reducing gas supplied to the catalyst 20 in the second air-fuel ratio reduction control, and hence to decrease the amount of hydrogen generated in the catalyst 20.

Figure 11:
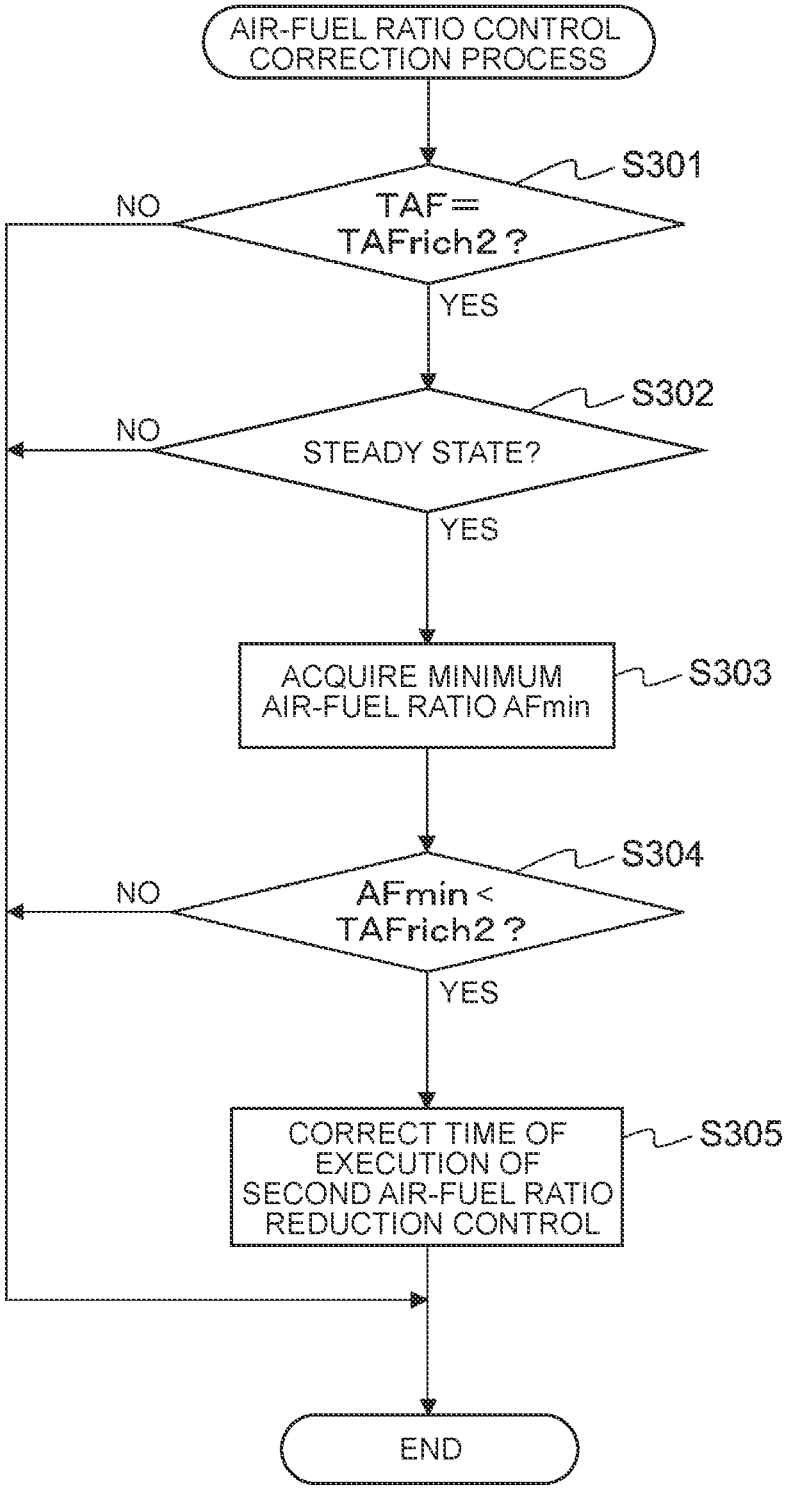
FIG. 11 is a flowchart illustrating a control routine of an air-fuel ratio control correction process according to a third embodiment of the present disclosure.

FIG. 11 is a flowchart illustrating a control routine of an air-fuel ratio control correction process according to the third embodiment. The present control routine is repeatedly executed by the ECU 31 that functions as the air-fuel ratio control device.

First, in step S301, the air-fuel ratio control device determines whether the target air-fuel ratio TAF for the in-flow exhaust gas is set to the second rich setting air-fuel ratio TAFrich2, that is, whether the second air-fuel ratio reduction control of the post-recovery rich control is being executed. When it is determined that the target air-fuel ratio TAF for the in-flow exhaust gas is not set to the second rich setting air-fuel ratio TAFrich2, the present control routine is ended.

When it is determined in step S301 that the target air-fuel ratio TAF for the in-flow exhaust gas is set to the second rich setting air-fuel ratio TAFrich2, the present control routine proceeds to step S302. In step S302, as in step S112 in FIG. 7C, the air-fuel ratio control device determines whether the operation state of the internal combustion engine is steady. When it is determined that the operation state of the internal combustion engine is not steady, the present control routine is ended. When it is determined that the operation state of the internal combustion engine is steady, on the other hand, the present control routine proceeds to step S303.

In step S303, the air-fuel ratio control device acquires the minimum air-fuel ratio AFmin obtained when the output air-fuel ratio of the downstream air-fuel ratio sensor 42 is varied to the rich side through the second air-fuel ratio reduction control.

Then, in step S304, the air-fuel ratio control device makes a comparison between the minimum air-fuel ratio AFmin acquired in step S303 and the second rich setting air-fuel ratio TAFrich2, which is the target air-fuel ratio in the second air-fuel ratio reduction control, and determines whether it is necessary to correct the parameters related to the second air-fuel ratio reduction control. Specifically, the air-fuel ratio control device determines whether the minimum air-fuel ratio AFmin is less than the second rich setting air-fuel ratio TAFrich2, that is, the minimum air-fuel ratio AFmin is richer than the second rich setting air-fuel ratio TAFrich2. When it is determined in step S304 that the minimum air-fuel ratio AFmin is equal to or more than the second rich setting air-fuel ratio TAFrich2, the present control routine is ended.

When it is determined in step S304 that the minimum air-fuel ratio AFmin is richer than the second rich setting air-fuel ratio TAFrich2, on the other hand, the present control routine proceeds to step S305. In step S305, the air-fuel ratio control device corrects the time of execution of the second air-fuel ratio reduction control. For example, the air-fuel ratio control device decreases the time of execution of the second air-fuel ratio reduction control by subtracting a predetermined slight time from the time of execution of the second air-fuel ratio reduction control. The air-fuel ratio control device may subtract a value that is proportional to the difference between the second rich setting air-fuel ratio TAFrich2 and the minimum air-fuel ratio AFmin, in place of the predetermined slight time, from the time of execution of the second air-fuel ratio reduction control.

A lower limit value of the time of execution of the second air-fuel ratio reduction control may be determined in advance, and the air-fuel ratio control device may correct the time of execution of the second air-fuel ratio reduction control in the range of the lower limit value or more. Consequently, it is possible to suppress oxygen in the catalyst 20 being not sufficiently reduced in the post-recovery rich control because of excessive correction. After step S305, the present control routine is ended.

In step S304, the air-fuel ratio control device may determine whether it is necessary to correct parameters related to the second air-fuel ratio reduction control using an average value of detected air-fuel ratios of the in-flow exhaust gas in the second air-fuel ratio reduction control, that is, an average value of air-fuel ratios detected by the upstream air-fuel ratio sensor 41 during execution of the second air-fuel ratio reduction control, in place of the second rich setting air-fuel ratio TAFrich2. In this case, in step S304, the air-fuel ratio control device determines whether the minimum air-fuel ratio AFmin is richer than the average value of the detected air-fuel ratios of the in-flow exhaust gas in the second air-fuel ratio reduction control.

In step S305, the air-fuel ratio control device may correct the target air-fuel ratio for the in-flow exhaust gas in the second air-fuel ratio reduction control, that is, the second rich setting air-fuel ratio TAFrich2, to the lean side. In this case, the air-fuel ratio control device reduces the degree of richness (difference from the stoichiometric air-fuel ratio) of the second rich setting air-fuel ratio TAFrich2 through correction. In step S305, the air-fuel ratio control device may decrease the time of execution of the first air-fuel ratio reduction control and the second air-fuel ratio reduction control, or correct the first rich setting air-fuel ratio TAFrich1 and the second rich setting air-fuel ratio TAFrich2 to the lean side.

In the post-recovery rich control, the target air-fuel ratio for the in-flow exhaust gas may be maintained at a single set value, rather than being switched between two steps. In this case, it is determined in step S301 that the post-recovery rich control is being executed, and a comparison is made in step S304 between the target air-fuel ratio (rich setting air-fuel ratio) for the in-flow exhaust gas in the post-recovery rich control and the minimum air-fuel ratio AFmin.

Other embodiments will be described. While preferable embodiments of the present disclosure have been described above, the present disclosure is not limited to such embodiments, and various modifications and changes may be made within the scope of the claims. For example, a downstream catalyst that is similar to the catalyst 20 may be disposed in the exhaust passage downstream of the catalyst 20 in the internal combustion engine.

The air-fuel ratio control device may execute first oxygen occlusion amount fluctuation control (active control) in which the air-fuel ratio of the in-flow exhaust gas is controlled such that the amount of oxygen occluded in the catalyst 20 is varied between zero and the maximum value, in place of the slightly rich control and the stoichiometric air-fuel ratio control. In this case, the air-fuel ratio reduction control and the air-fuel ratio increase control are executed in the first oxygen occlusion amount fluctuation control, and the air-fuel ratio control device corrects parameters related to the air-fuel ratio reduction control in the first oxygen occlusion amount fluctuation control.

The air-fuel ratio control device may execute second oxygen occlusion amount fluctuation control in which the air-fuel ratio of the in-flow exhaust gas is controlled such that the amount of oxygen occluded in the catalyst 20 is varied between zero and a predetermined value that is less than the maximum value, in place of the slightly rich control and the stoichiometric air-fuel ratio control. In this case, the air-fuel ratio reduction control and the air-fuel ratio increase control are executed in the second oxygen occlusion amount fluctuation control, and the air-fuel ratio control device corrects parameters related to the air-fuel ratio reduction control in the second oxygen occlusion amount fluctuation control.

The embodiments discussed above can be implemented in any combination. For example, when the first embodiment or the second embodiment and the third embodiment are combined, the control routine in FIGS. 7A to 7D or the control routine in FIGS. 9A to 9E and the control routine in FIG. 11 are executed concurrently. In this case, the condition for executing the air-fuel ratio control in step S101 of FIGS. 7A and 9A includes the fuel cut control and the post-recovery rich control not being executed.

What is claimed is:

1. An exhaust gas control apparatus for an internal combustion engine, comprising:

a catalyst disposed in an exhaust passage of the internal combustion engine and configured to be able to occlude oxygen;

an air-fuel ratio sensor configured to detect an air-fuel ratio of an out-flow exhaust gas that flows out of the catalyst; and an air-fuel ratio control device configured to control an air-fuel ratio of an in-flow exhaust gas that flows into the catalyst to a target air-fuel ratio, wherein the air-fuel ratio control device is configured to execute air-fuel ratio reduction control in which the target air-fuel ratio is set to a rich setting air-fuel ratio that is richer than a stoichiometric air-fuel ratio, and to correct a parameter related to the air-fuel ratio reduction control such that an amount of a reducing gas supplied to the catalyst in the air-fuel ratio reduction control is decreased in a case where a minimum air-fuel ratio obtained when the air-fuel ratio of the out-flow exhaust gas detected by the air-fuel ratio sensor is varied to a rich side through the air-fuel ratio reduction control is richer than the rich setting air-fuel ratio or an average value of detected air-fuel ratios of the in-flow exhaust gas in the air-fuel ratio reduction control.

2. The exhaust gas control apparatus for an internal combustion engine according to claim 1, wherein the air-fuel ratio control device is configured to correct the parameter related to the air-fuel ratio reduction control to a lean side when the minimum air-fuel ratio is richer than the rich setting air-fuel ratio or the detected air-fuel ratio.

3. The exhaust gas control apparatus for an internal combustion engine according to claim 2, wherein:

the air-fuel ratio control device is configured to end the air-fuel ratio reduction control when the air-fuel ratio of the out-flow exhaust gas detected by the air-fuel ratio sensor is reduced to be equal to or less than a lower determination air-fuel ratio that is richer than the stoichiometric air-fuel ratio in the air-fuel ratio reduction control; and the parameter related to the air-fuel ratio reduction control includes the lower determination air-fuel ratio.

4. The exhaust gas control apparatus for an internal combustion engine according to claim 2, wherein:

the air-fuel ratio control device is configured to start air-fuel ratio increase control in which the target air-fuel ratio is set to a lean setting air-fuel ratio that is leaner than the stoichiometric air-fuel ratio when the air-fuel ratio of the out-flow exhaust gas detected by the air-fuel ratio sensor is reduced to be equal to or less than a lower determination air-fuel ratio that is richer than the stoichiometric air-fuel ratio in the air-fuel ratio reduction control, and to start the air-fuel ratio reduction control when the air-fuel ratio of the out-flow exhaust gas detected by the air-fuel ratio sensor is increased to be equal to or more than an upper determination air-fuel ratio that is leaner than the lower determination air-fuel ratio in the air-fuel ratio increase control; and the parameter related to the air-fuel ratio reduction control includes the lower determination air-fuel ratio and the upper determination air-fuel ratio.

5. The exhaust gas control apparatus for an internal combustion engine according to claim 2, wherein the parameter related to the air-fuel ratio reduction control includes the rich setting air-fuel ratio.

6. The exhaust gas control apparatus for an internal combustion engine according to claim 1, wherein the parameter related to the air-fuel ratio reduction control includes a time of execution of the air-fuel ratio reduction control.

7. The exhaust gas control apparatus for an internal combustion engine according to claim 1, wherein:

the air-fuel ratio control device is configured to start air-fuel ratio increase control in which the target air-fuel ratio is set to a lean setting air-fuel ratio that is leaner than the stoichiometric air-fuel ratio when the air-fuel ratio of the out-flow exhaust gas detected by the air-fuel ratio sensor is reduced to be equal to or less than a lower determination air-fuel ratio that is richer than the stoichiometric air-fuel ratio in the air-fuel ratio reduction control, and to start the air-fuel ratio reduction control when the air-fuel ratio of the out-flow exhaust gas detected by the air-fuel ratio sensor is increased to be equal to or more than an upper determination air-fuel ratio that is leaner than the lower determination air-fuel ratio in the air-fuel ratio increase control; and the air-fuel ratio control device is configured to correct the upper determination air-fuel ratio and the lower determination air-fuel ratio such that a difference between the upper determination air-fuel ratio and the lower determination air-fuel ratio becomes small when the air-fuel ratio of the out-flow exhaust gas detected by the air-fuel ratio sensor is not varied to a lean side during a period since the air-fuel ratio increase control is started until a predetermined threshold time elapses.

8. An exhaust gas control method for an internal combustion engine, the internal combustion engine including a catalyst disposed in an exhaust passage of the internal combustion engine and configured to be able to occlude oxygen, an air-fuel ratio sensor configured to detect an air-fuel ratio of an out-flow exhaust gas that flows out of the catalyst, and an air-fuel ratio control device configured to control an air-fuel ratio of an in-flow exhaust gas that flows into the catalyst to a target air-fuel ratio, the exhaust gas control method comprising:

executing air-fuel ratio reduction control in which the target air-fuel ratio is set to a rich setting air-fuel ratio that is richer than a stoichiometric air-fuel ratio; and correcting a parameter related to the air-fuel ratio reduction control such that an amount of a reducing gas supplied to the catalyst in the air-fuel ratio reduction control is decreased in a case where a minimum air-fuel ratio obtained when the air-fuel ratio of the out-flow exhaust gas detected by the air-fuel ratio sensor is varied to a rich side through the air-fuel ratio reduction control is richer than the rich setting air-fuel ratio or an average value of detected air-fuel ratios of the in-flow exhaust gas in the air-fuel ratio reduction control.

* * * * *